US006324441B1

(12) United States Patent
Yamada

(10) Patent No.: US 6,324,441 B1
(45) Date of Patent: Nov. 27, 2001

(54) EMBROIDERY DATA PROCESSOR AND RECORDING MEDIUM STORING EMBROIDERY DATA PROCESSING PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/538,296

(22) Filed: Mar. 30, 2000

(30) Foreign Application Priority Data

Apr. 1, 1999 (JP) ..... 11-131827

(51) Int. Cl.[7] ..... D05C 5/06; G06F 19/00

(52) U.S. Cl. ..... 700/138; 112/102.5

(58) Field of Search ..... 700/138, 136, 700/137, 130, 131, 132; 112/102.5, 470.04, 470.06, 475.19

(56) References Cited

U.S. PATENT DOCUMENTS 5,794,553 * 8/1998 Futamura ..... 112/102.5
6,098,554 * 8/2000 Orii et al. ..... 700/138 X
6,158,364 * 12/2000 Orii et al. ..... 700/138 X

* cited by examiner

*Primary Examiner*—Peter Nerbun
(74) *Attorney, Agent, or Firm*—Oliff & Berridge, PLC

(57) ABSTRACT

Image data is converted into a mosaic image formed from blocks that are elongated in a stitching direction. In the mosaic image, blocks adjacent in the direction perpendicular to the stitching direction, that is, vertically adjacent blocks, are shifted out of alignment in the stitching direction. A thread color is set for each of the blocks, and embroidery data is produced accordingly. When embroidery patterns are sewn using this embroidery data, lines in the perpendicular direction will not stand out because blocks adjacent in the perpendicular direction are shifted out of alignment in the stitching direction. Also, because the blocks are shortened in the perpendicular direction, the resolution is enhanced and lines in the stitch direction will also not stand out.

18 Claims, 26 Drawing Sheets

(12 of 26 Drawing Sheet(s) Filed in Color)

THREAD COLOR DATABASE

THREAD

| COLOR CODE | (R, G, B) |
|---|---|
| 001 | (000, 000, 000) |
| 002 | (255, 000, 000) |
| 003 | (000, 255, 000) |
| 004 | (000, 000, 255) |
| 005 | (255, 255, 000) |

EMBROIDERY DATA PROCESSOR AND RECORDING MEDIUM STORING EMBROIDERY DATA PROCESSING PROGRAM

BACKGROUND OF THE INVENTION

The present invention relates to an embroidery data processor for processing embroidery data based on an optional image. The embroidery data is used in a sewing machine to sew embroidery stitches. The present invention also relates to a recording medium which stores therein a program for operating a computer, the program being used for embroidery data processing.

An embroidery sewing machine includes an embroidery frame disposed above a sewing machine bed, and a horizontal movement mechanism for moving the frame horizontally. The horizontal movement mechanism moves the frame, with a workpiece cloth supported therein, horizontally to positions indicated by an X-Y coordinate system of the sewing machine. In synchronization with this, sewing operations are performed using the sewing needle and shuttle mechanism to sew a desired embroidery pattern in the workpiece cloth.

A microcomputer is provided internally in the sewing machine. The microcomputer configures a control device for controlling operations of the horizontal movement mechanism, a needle bar that supports the sewing needle, and other components. The control device automatically performs embroidery operations according to embroidery data, which is otherwise known as stitch data. Embroidery data indicates the amount that the workpiece cloth needs to be moved between stitches, that is, from one stitch position to a subsequent stitch position, in order to properly align the needle with a desired position on the workpiece cloth for the subsequent stitch.

Embroidery data producing devices are available for producing embroidery data from optional images. One example of an embroidery data producing device produces embroidery data from data representing contours of figures or closed regions.

SUMMARY OF THE INVENTION

However, it has been difficult to automatically form embroidery data from pattern data such as photographic images. In one conceivable method, pattern data is converted into a mosaic image. The blocks of the mosaic image must be large enough to cross stitch or fill in with stitching. FIGS. 24(*a*) and 24(*b*) show the relation of needle diameter and interstitch distance, also referred to as stitch width. In these drawings, N designates a sewing needle and T designates a needle thread. FIG. 24(*a*) shows two adjacent stitches separated by a reasonable stitch width W1, and FIG. 24(*b*) shows two adjacent stitches separated by an extremely small stitch width W2. Because the stitch width W2 shown In FIG. 24(*b*) is too narrow, the cloth between the two holes formed by the needle may tear, or the two holes can otherwise connect to form a large single hole. To prevent this, the stitch width needs to be about twice the diameter of the needle. Therefore, the mosaic of the pattern can not be formed from blocks smaller than twice the diameter of the needle.

For this reason, It Is impossible to represent details of a complicated pattern using a mosaic Image. For example, the facial photograph shown in FIG. 4 converts into the mosaic image shown in FIG. 25, and the mosaic image of FIG. 25 converts into the stitch data shown In FIG. 26. As can be understood by these figures, vertical and horizontal lines stand out so that the eyes, nose, and other facial features of the man in the photograph become unrecognizable.

It is an object of the present invention to provide an embroidery data processor capable of automatically producing embroidery data that closely resembles an original pattern, even a complicated original pattern such as a photograph.

This and other object of the present invention will be attained by providing an embroidery data processor for converting an image data into an embroidery data comprising means for holding a first image as a first Image data from an original image, the first image data containing color data; means for storing a plurality of thread color data In which a relationship between thread color Information and color codes is stored; means for selecting a thread color information from the plurality of thread color data stored in the storing means, the selecting means dividing the first image into a plurality of blocks, each block having a first side and a second side shorter than the first side, and the selecting means also selecting a thread color information from the plurality of thread color data stored in the storing means based on each color data contained in each block; and means for producing embroidery data for performing embroidery stitching to each of the blocks with a selected color code corresponding to the selected thread color information.

In another aspect of the invention, there is provided a recording medium storing embroidery data processing program for operating a computer system, the program comprising a program for holding a first image as a first image data from an original image, the first image data containing color data; a program for storing a plurality of thread color data in which a relationship between thread color information and color codes is stored; a program for selecting a thread color information from the plurality of thread color data stored in the storing means. the selecting means dividing the first image into a plurality of blocks, each block having a first side and a second side shorter than the first side, and selecting a thread color information from the plurality of thread color data stored in the storing means based on each color data contained in each block; and a program for producing embroidery data for performing embroidery stitching to each of the blocks with a selected color code corresponding to the selected thread color information.

BRIEF DESCRIPTION OF THE DRAWINGS

The file for this patent contains at least one drawings executed in color. Copies of this patent with color drawings will be provided by the Patent and Trademark office upon request and payment of the necessary fee.

In the drawings:

FIG. 23(*b*) is a view for description of block generating direction, in which blocks in a subsequent block line (lower block row) is produced in a direction opposite the block generating direction in a precedent block line (upper block row);

FIG. 24(*b*) is a schematic view showing adjacent needle locations too close together;

DETAILED DESCRIPTION OF THE PREFERRED EMBODIMENT

An embroidery data processor and a recording medium which stores an embroidery data processing program readable by a computer according to preferred embodiments of the present invention will be described with reference to drawings. The embodiments described below pertain to embroidery data processors capable of converting a pattern data inputted through an optional method into embroidery data and storing the embroidery data in a non-volatile memory card. An embroidery sewing machine with a memory card unit can retrieve the embroidery data from the memory card and performs embroidery operations accordingly.

An embroidery data processor according to a first embodiment of the present invention will be described with reference to FIGS. 1 through 10.

Figure 1:
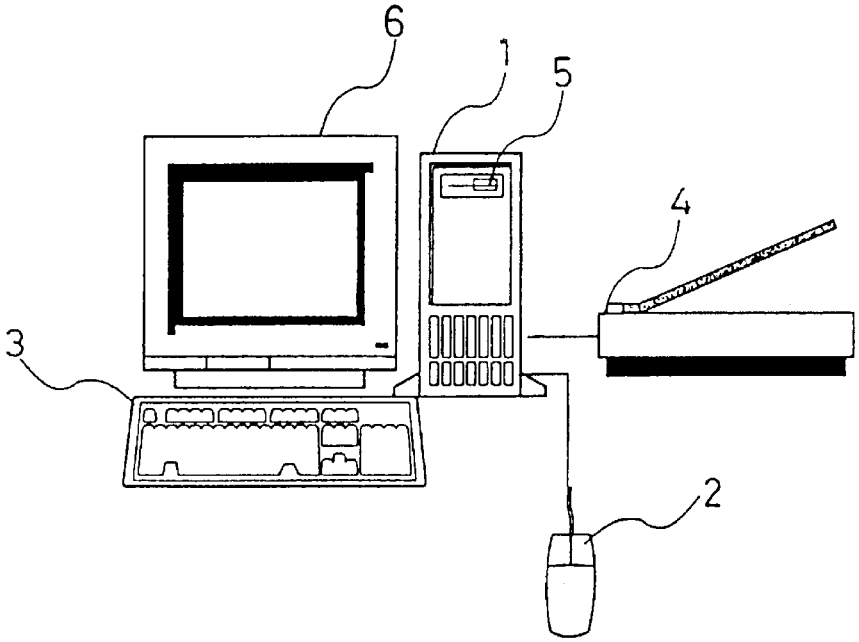
FIG. 1 is an external view showing a sewing data processor according to a first embodiment of the present invention.
Figure 2:
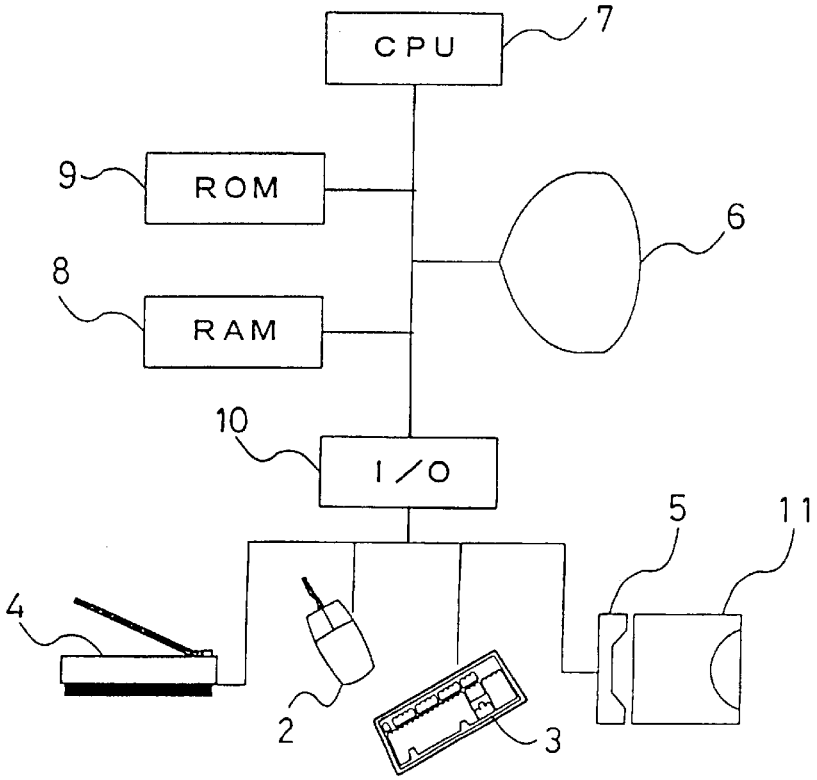
FIG. 2 is a block diagram showing the sewing data processor of FIG. 1.

As shown in FIG. 1, the embroidery data processor includes an embroidery data processor portion 1, a mouse 2, a keyboard 3, an image scanner 4, a memory card connector 5, and a display 6. In a block diagram shown in FIG. 2, the embroidery data processor portion 1 includes mainly a CPU 7, a RAM 8, a ROM 9, and an input/output interface 10. The mouse 2, the keyboard 3, the image scanner 4, and the memory card connector 5 are connected to the input/output interface 10. The memory card connector 5 includes a memory card 11 serving as the recording medium.

When the embroidery data processor portion 1 is started up, the CPU 7 executes the program codes prestored in the ROM 9, so that various types of embroidery data processes can be performed by the embroidery data processor portion 1.

Next, processes performed in the embroidery data processor portion 1 when an operator wants to produce embroidery data from the multi-value facial image shown in FIG. 4 will be described with reference to the flowchart in FIG. 3. In the process, the multi-value image in FIG. 4 contains 400 pixels array in a horizontal direction and 600 pixels array in a vertical direction (totally 240,000 pixels). The embroidery data produced in the embroidery data processor portion 1 from this image is for producing an actual embroidery pattern having a width(horizontal length) of 100 mm and a height of 150 mm.

When this program is started, a pattern is retrieved using the image scanner 4 (S10). In this example, the retrieved pattern is the color picture of the "face" shown in FIG. 4. However any other type of image, such as a monochrome photograph or a hand-drawn picture, can be retrieved instead.

In the present embodiment, the image scanner 4 is capable of retrieving the pattern as color image data that represents each of the colors red(R), green(G), and blue(B) using eight bits (0 to 255) for each color. The image data of the retrieved pattern is stored in an original Image memory region in the RAM 8, as bit map data in a raster format. The stored image data corresponds to a first image data.

Next in S20 shifting or displacing direction of block is set. As will be described in more detail in connection with S60, in the process of S20, the retrieved pattern image is divided into a plurality of rectangles, referred to as "blocks," and a thread color is determined for each block. The blocks are arrayed in a line direction (horizontal direction) following their widthwise dimension. The retrieved pattern image is expressed by a plurality of the block rows stacked on top of each other in layers. Each row of blocks is shifted laterally from the row immediately prior, or in this example, from the row immediately above. Said differently, blocks are shifted laterally from blocks in adjacent rows by an amount inputted in S50 (to be described later), so that no blocks are positioned directly beneath blocks in an adjacent row. In other words, a vertical side of an upper block in an upper block line is not in alignment with a vertical side of a lower block in a lower block line, the lower block being positioned immediately below the upper block. In the present embodiment, a horizontal direction (rightward) is set as the block shift direction in S20. It should be noted that in the present embodiment, a widthwise direction of the blocks corresponds to a stitch direction. Therefore, step S20 corresponds to means for inputting a stitching direction.

Next, in S30 a dimension of the blocks in the widthwise direction and in the direction perpendicular to the widthwise direction are inputted in millimeter units. In other words, the width and height of the blocks are set. In this example, the blocks are set with a width of 3 mm and a height of 1 mm.

Next, in S40, the inputted block width and height is converted from millimeters into pixel numbers. In this example, the block width is converted into 12 pixels [(400 pixels/100 mm)×3 mm] and the block height is converted into 4 pixels [(600 pixels/150 mm)×1 mm].

Next, in S50 laterally shifting or displacing amount of block is set. The extent of block shift is inputted as a percentage of the block width. In this example, the degree of block shift Is set to 30% of the block width. By suitably selecting the laterally shifting amount of the block, resultant embroidery data with superior power of expression can be produced. Then, in S60, image conversion processing is performed based on the image inputted in S10. This operation will be described while referring to the flowchart in FIG. 5.

In this routine, the pattern image retrieved in S10 is broken down into blocks in which block formation starts from the upper left position of the pattern image to the right. Each time the block is set, a representative color of the block is set. When representative colors of the first row of blocks (uppermost line of block) is set, i.e., when the colors of uppermost line of the blocks are set, a block immediately beneath the first block of the uppermost line of blocks is set, and the representative block color is set. This process is repeated until all area of the pattern image are converted into blocks.

In more detail, first in S110 a counter "n" is set to zero. The counter "n" represents the number of blocks in the vertical direction (direction of height of the block). In S120, the vertical starting position Y1 of the subject block row is computed by multiplying the block height times the counter "n". Because the block height is 4 pixels in the present embodiment, then Y1=4×n.

Next, in S130 the horizontal starting position X1 of the block row is computed. First, the block width (12 pixels), the extent of block shift (30% of block width), and the counter "n" are multiplied together (12×(30/100)×n). This computation implies the starting position of the first block at (n+l)th line of block rows. However, if "n" is increased, the starting position is shifted toward right as a result of multiplication, and the shifting length may become greater than one block width. Therefore, the product obtained by the computation is then divided by one block width to the closest integer. The "remainder" represents the vertical left side of the leftmost block of the block row, i.e., the horizontal starting position X1.

Then, in S140, a counter "m" is set to zero. The counter "m") represents the number of blocks in the horizontal direction. Then in S150 the horizontal starting position X2 of the present block is computed by adding the horizontal starting position X1 (of the block row) to the product of the block width (12 pixels) and the counter "m", that is, X2=X1+12=m. The first time the routine is run, (X2, Y1=(0,0), which indicates the upper left position on the first image data, because "n" and "m" are initially zero.

In S160, the representative color for each block is computed as the total values for each color red (R), green (G), and blue (B) of all pixels enclosed in the subject block, which extends to a height of 4 pixels and a width of 12 pixels from a starting point of (X2, Y2). The total value for each color is divided by the number of pixels included in each block. In this example, each block includes 48 pixels (4×12=48). The thus computed R,G. and B values become the representative color of the block.

Then in S170, the counter "m" in the horizontal direction of the block is incremented by one. In S180, whether image conversion processes have been completed for all blocks in the subject row is judged. This is judged by determining whether the horizontal start position of the next block whose representative color is to be computed is beyond the width of the first image data. If processes have not been completed for all blocks in the row, then the routine returns back to S150, whereupon the representative color of the next block is determined. Because the counter "m" is incremented by one in S170, the "next block" will be the block to the immediate right of the present block. When processes have been completed for all blocks (S180:YES), then the routine proceeds to S190, whereupon the counter "n" in the vertical direction of the block is incremented by one.

Figure 6:
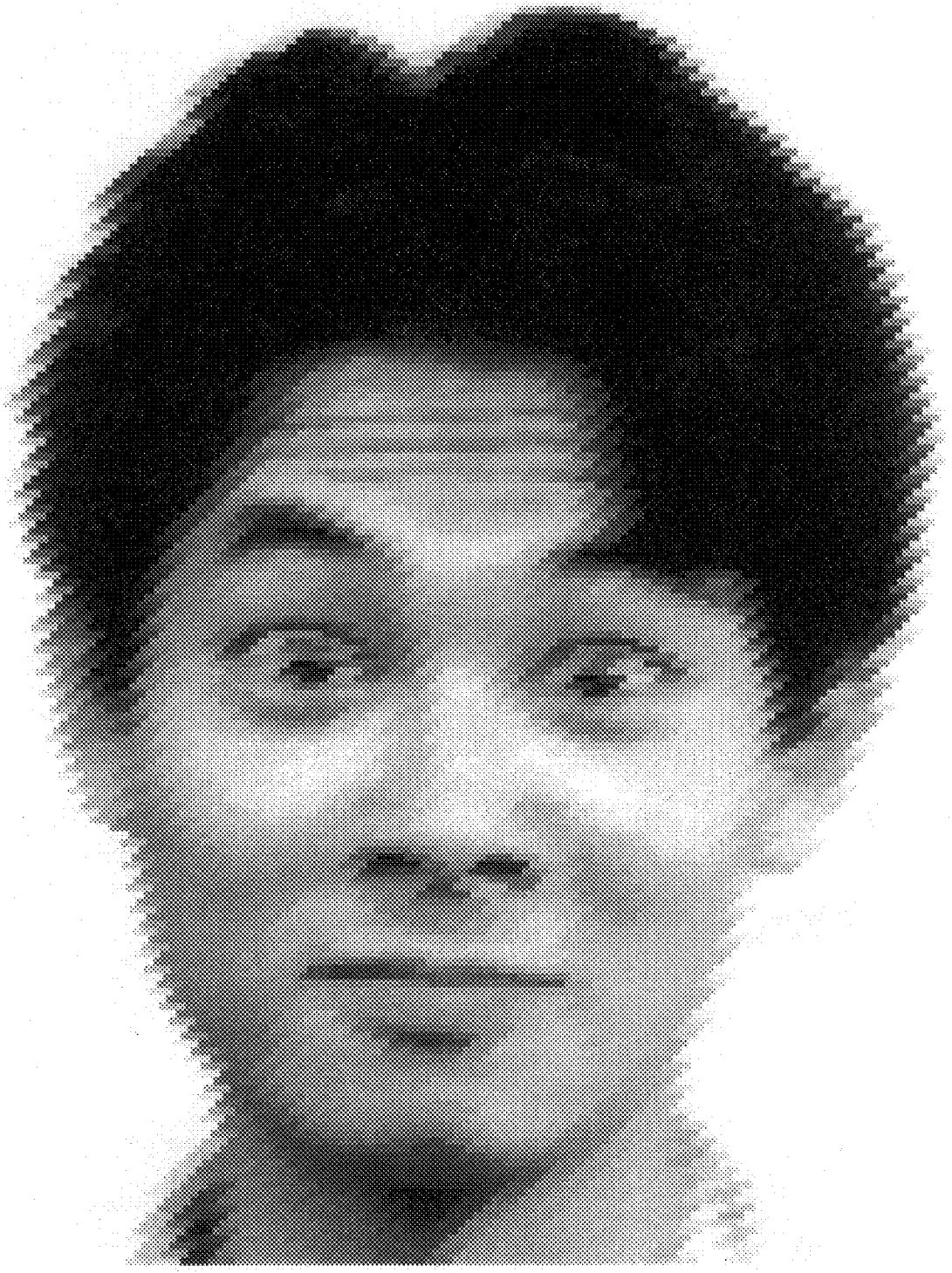
FIG. 6 shows a mosaic image generated from the original image of FIG. 4 as a result of the image conversion processing routine represented by the flowchart of FIG. 5.

Then in S200, it is judged whether or not image conversion processes have been performed for all of the first image data. This is judged by determining whether addition of one block height to the vertical starting position of the present block exceeds the height of the first image data. If not, then the routine returns back to S120, whereupon the representative color of blocks in the next row are determined. Because the counter "n" was incremented by one in S190, the "next row" will be the row directly beneath the present row. The computation performed in S130 increase the shift amount with each subsequent, that is, lower, row. However, one block width is the maximum possible shift amount, because the shift amount is the remainder after division by the block width. Also, because the counter "m" is set to zero in S140, the next block will be started at a position shifted from the left edge of the row by the shift amount. When conversion processes have been completed for all of the first image data, then this routine is completed. The image obtained in this manner is referred to as second image data. An example of second image data is shown in FIG. 6. The image conversion processing routine shown in FIG. 5 corresponds to image data converting means. With this configuration, the second image data can be visually confirmed. Moreover, because of the stitch direction input means (S20), optimum stitch direction can be inputted. Further, because of the shift amount input means (S50), optimum shift amount can be inputted.

Figure 3:
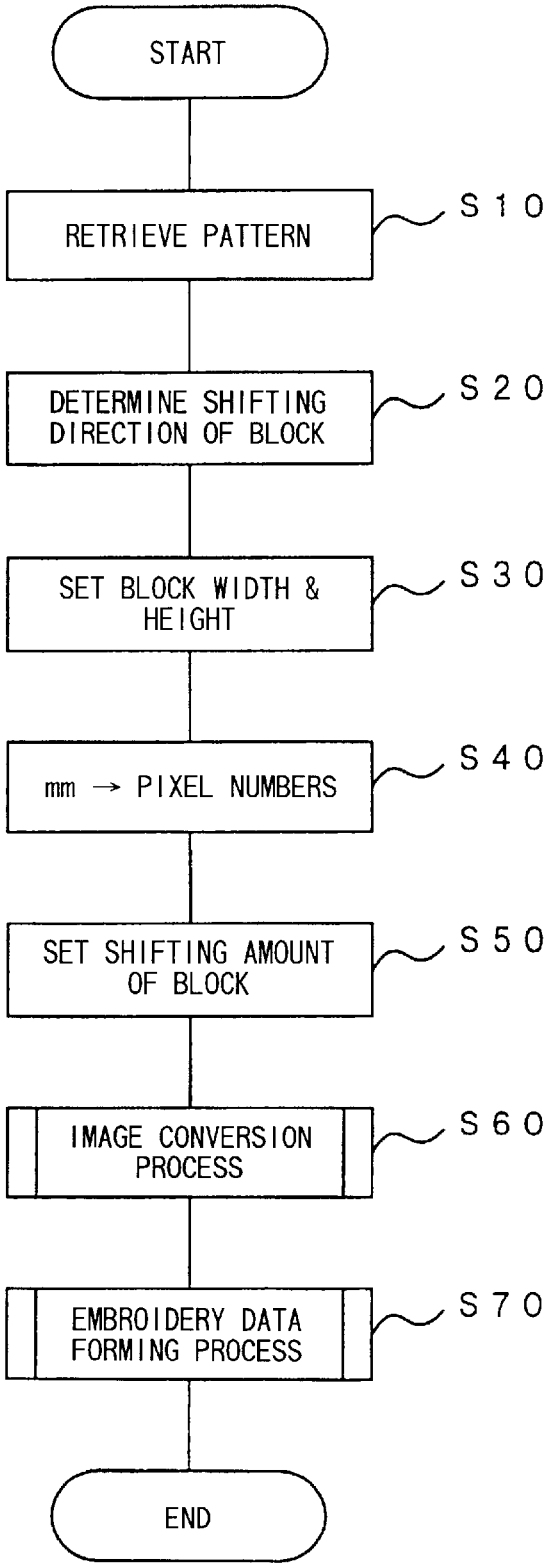
FIG. 3 is a flowchart representing an embroidery data processing routine according to the first embodiment of the present invention.
Figure 4:
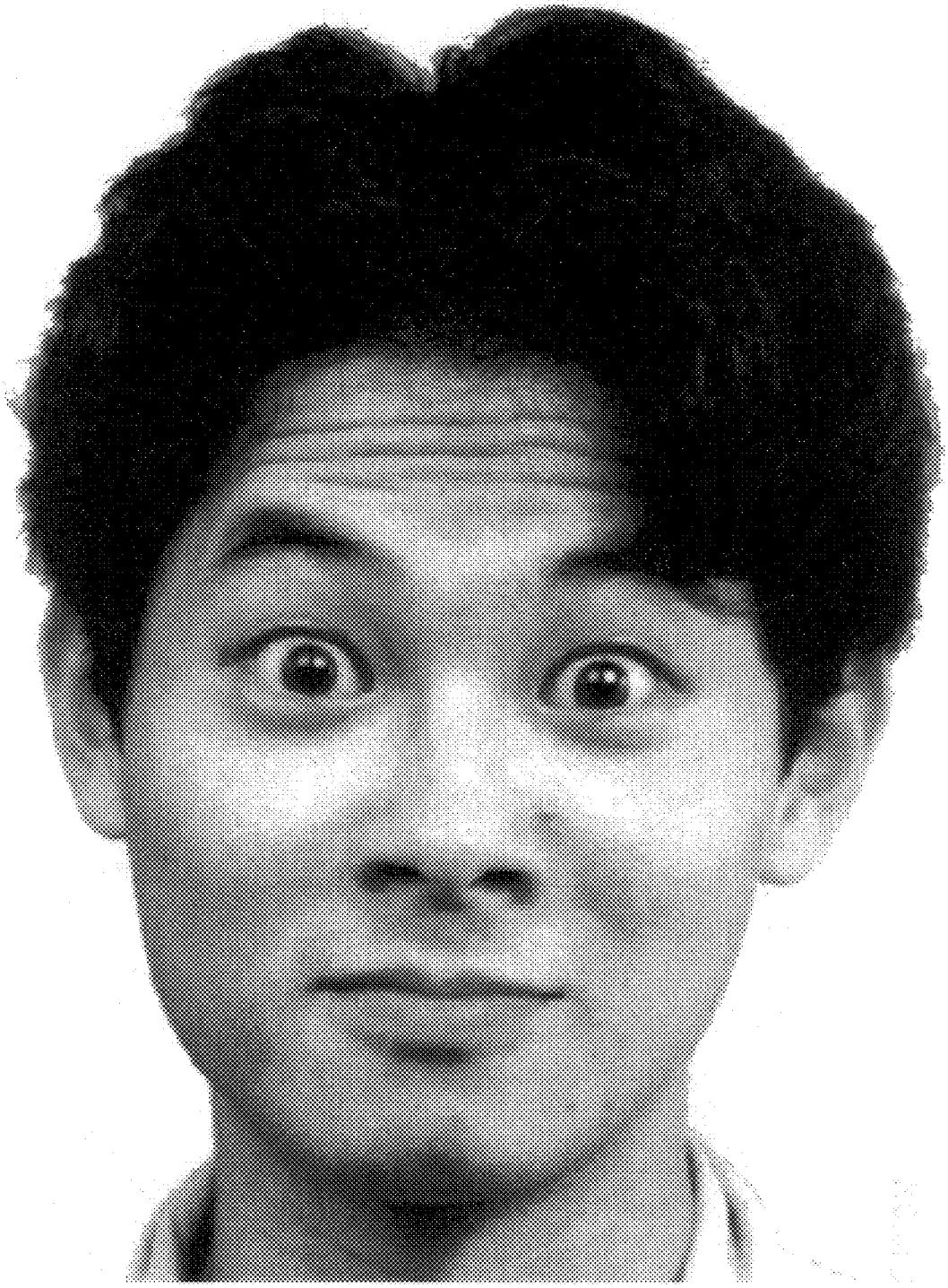
FIG. 4 shows an original image to be processed into embroidery data using the sewing data processor of FIG. 1.
Figure 5:
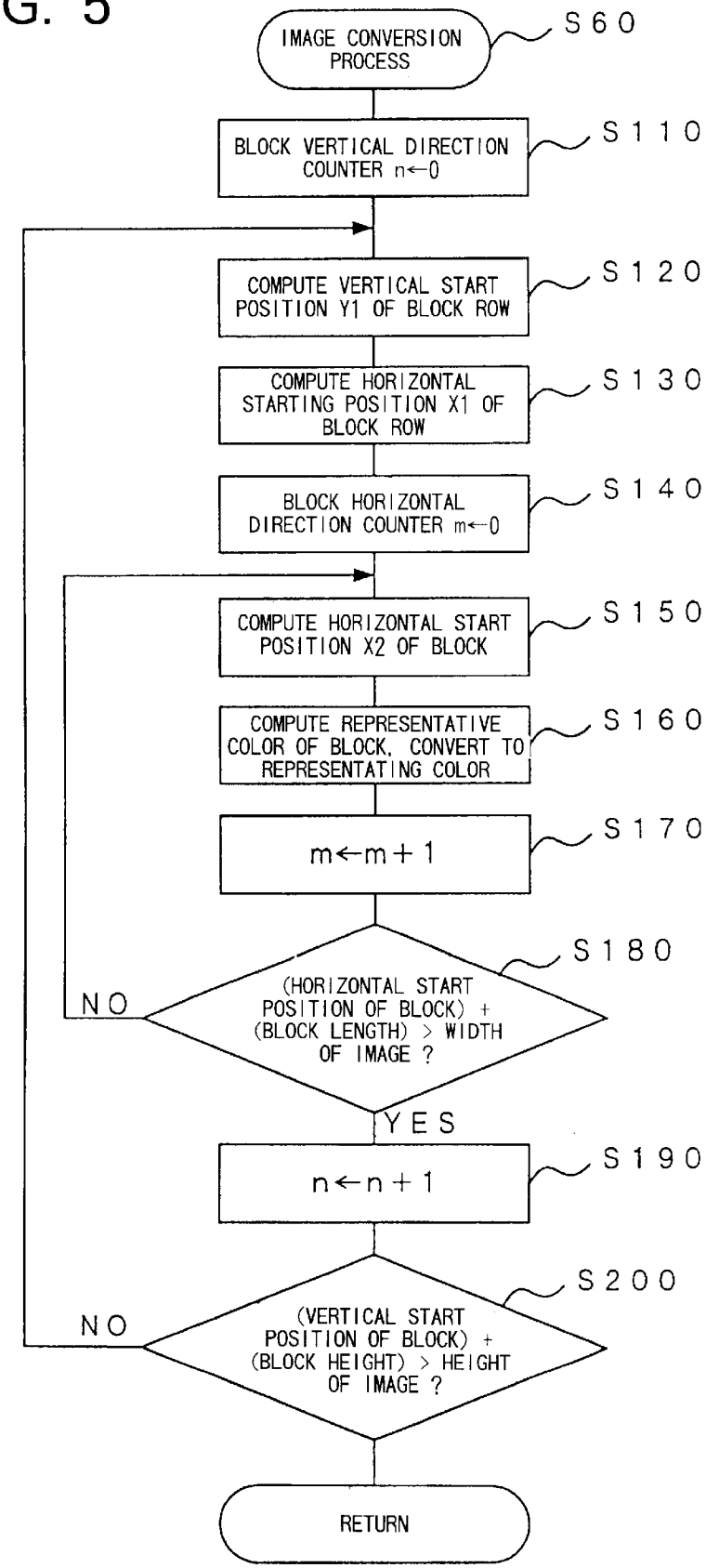
FIG. 5 is a flowchart representing an image conversion processing routine executed in the embroidery data processing routine of FIG. 3.
Figure 7:
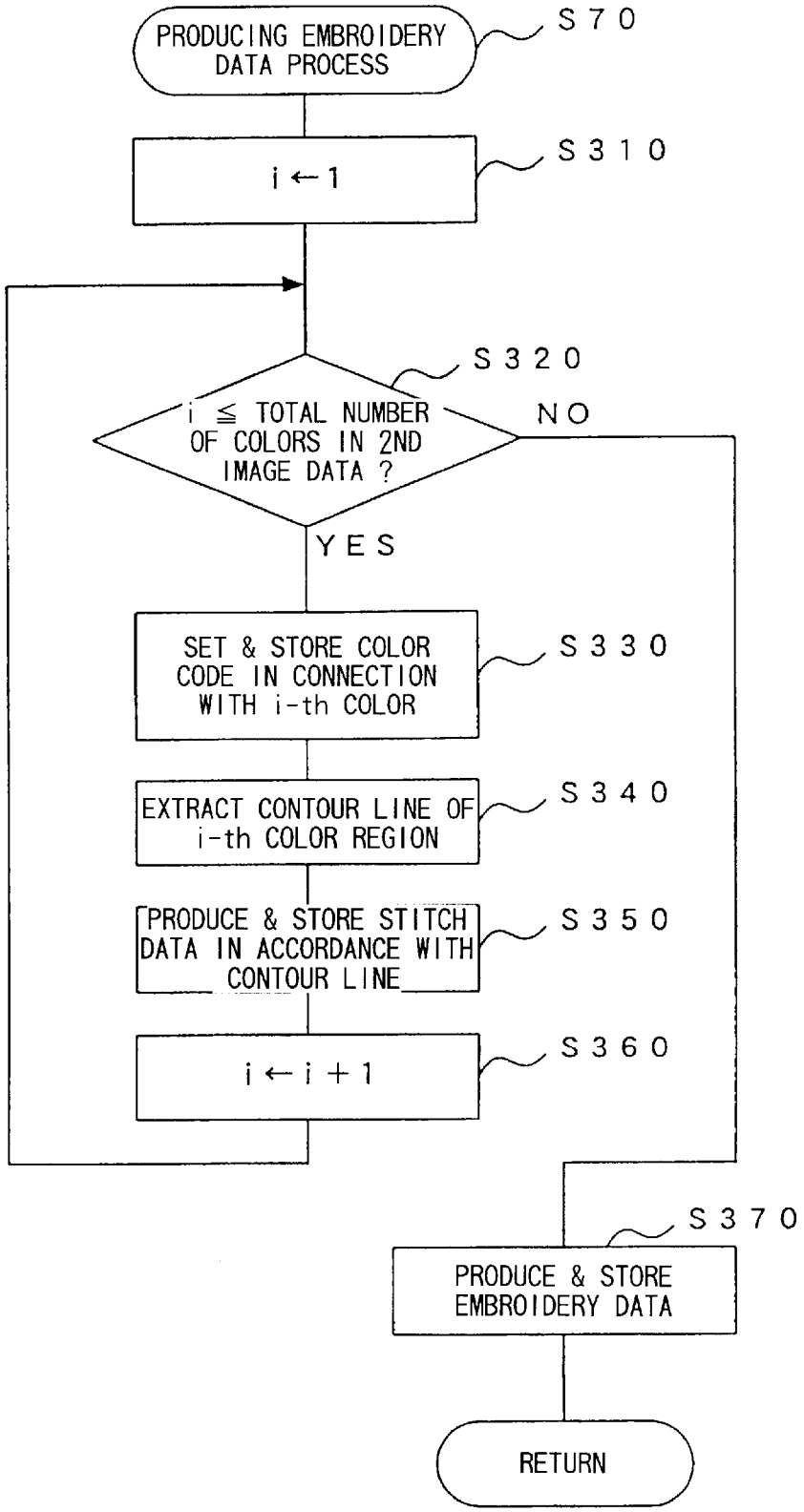
FIG. 7 is flowchart representing an embroidery data forming process executed in the embroidery data processing routine of FIG. 3.

Returning to the flowchart of FIG. 3, embroidery data is formed or produced in S70 after image conversion processing is completed in S60. The embroidery data producing routine is represented by the flowchart of FIG. 7. First, in S310 the value of a counter "i" is set to "1". The counter "i" indicates the number of colors obtained in S60 for the second image data, that have been processed up to present. That is, in subsequent processes, the value of the counter "i" is incremented by one each time a color is processed, and the corresponding thread colors are determined for each color. For example, if it is determined in S60 that the second image data includes 500 colors, then the counter "i" is incremented one at a time from 1 until 500 by processes to be described below. In S320, the value of the counter "i" is compared with the total number of colors in the second image data. If the value of the counter "i" is smaller than the total number of colors (S320:YES), then the routine proceeds to S330, whereupon a color code equivalent to the ith color is selected from a thread color database represented in FIG. 8. This color code is then stored.

In the depicted embodiment, the determination of the thread color is important because of the reason set forth below. That is, the first image data stored in the RAM 8, through the image scanner 4 is optional color data. Here, the more colors in the thread color data for reproducing the color image, the more faithfully that the color image can be expressed. However, it is extremely difficult to provide threads in 1,000 or more different colors. Accordingly, the thread color is selected from the most suitable color of the limited number of thread colors at hand. Also, even if a great number of different thread colors are available, different colors are used with different frequencies. For this reason, some particular thread color may be almost completely used up, and then never used again. That is, the number of thread colors that can be used fluctuates. To avoid this problem, a representative color is determined, and once the representative color is determined, then the thread color is determined based on the representative color. By this, it is easy to cope with changes in thread color.

Figure 8:
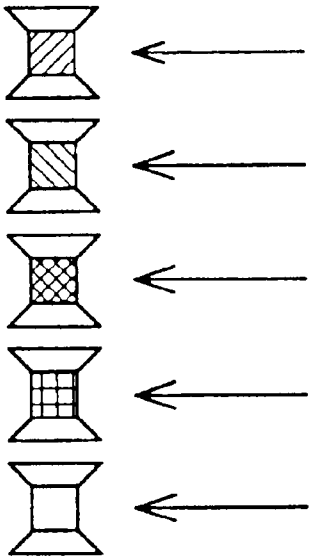
FIG. 8 is a schematic view for description of a relationship between a thread color database and actual thread colors.

The thread color is determined in the following manner. As shown in FIG. 8, the thread color database stores color codes assigned to a predetermined set of threads, and stores R.G.B. values of the thread color of each thread in correspondence with the color codes. The thread color is indicated in terms of red, green, and blue, by indicating how much of each of the colors red, green, and blue is present in the thread color.

The color in the thread color database that is nearest the image color presently being investigated, that is, the ith image color, is determined using the following formula 1.

$$d = \sqrt{(r1 - r2)^2 + (g1 - g2)^2 + (b1 - b2)^2}$$

wherein r1, g1, b1 represent the values for red, green, and blue respectively of the ith image color; and r2, g2, b2 represent the values for red, green, and blue respectively of the subject color code in the thread color database;

These two sets of values serve as coordinates for two points in a three dimensional RGB color system. One point indicates the ith image color and the other point indicates the subject thread color in the database. By using this formula, the distance between the two points, that is, how similar the two colors are, can be determined. Distances between the ith image color point and points representing all color codes in the database are determined. The color code which provides the shortest distance is set as the thread color for the ith image color. This color code set in this way is then stored in the RAM 8.

Figure 9:
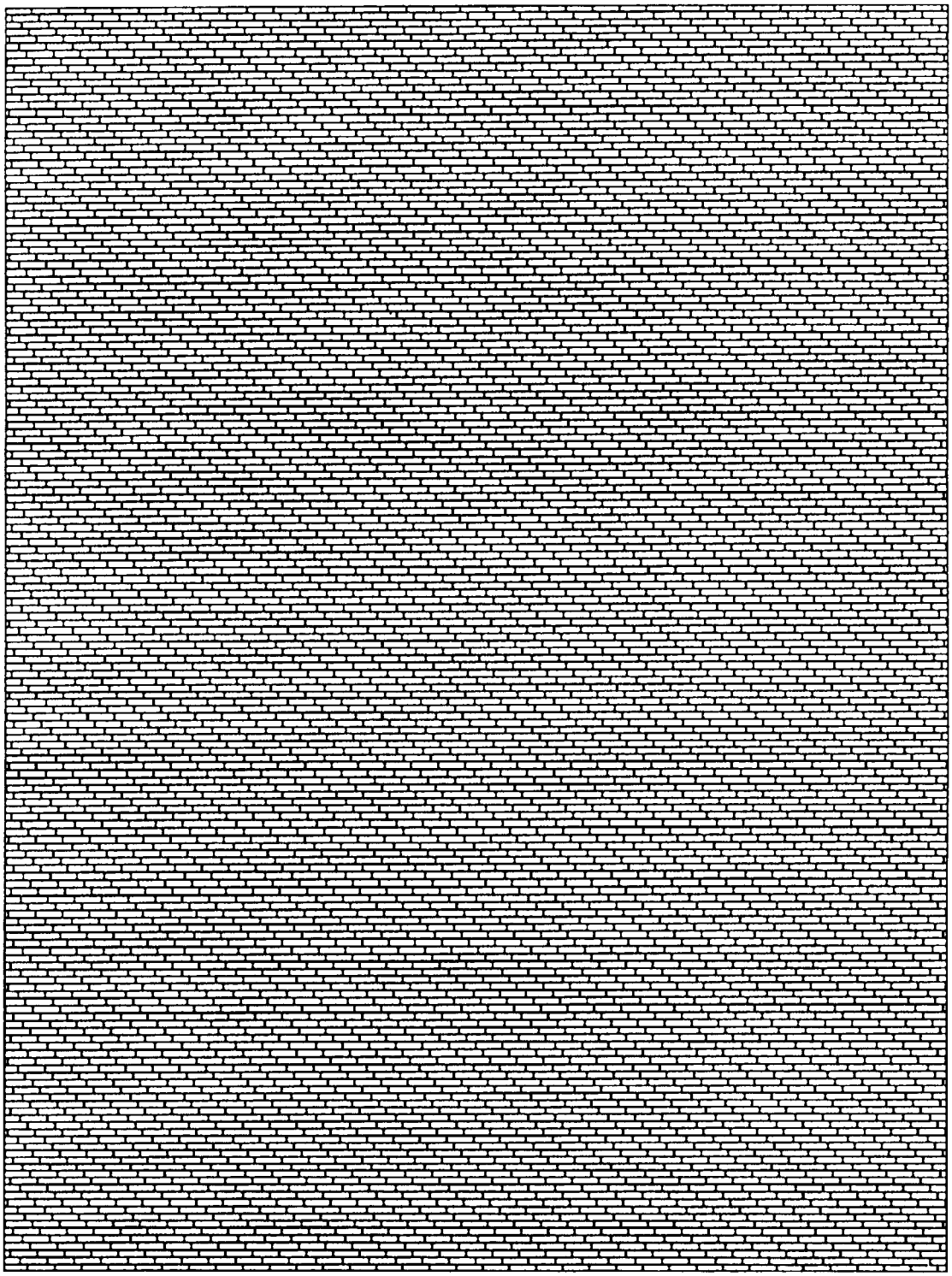
FIG. 9 is a schematic view showing blocks produced when extracting contour lines from the image of FIG. 4.

Next, in S340 a contour line in connection with i-th color region is extracted from the second image data. To do this, first the outer contour line of all blocks to be embroidered with the i-th color is extracted from the second image data. The resultant contour line is set as an outer form line of the embroidery data in association with the i-th color region. As will be described later, the counter i is incremented one at a time in S360, which changes the subject color of the process performed in S330, 340, and 350. Once the process of S340 has been performed for all blocks in the second image data of FIG. 6, then the result appears as shown in FIG. 9.

In S350, stitch data is produced for the outer form lines extracted in S340. The stitch data is produced by converting blocks of the subject color region into coordinate points of stitches (needle locations) for filling in the interior of the blocks. Explained in more detail, each block is converted into coordinate points used to stitch following the widthwise direction of the blocks. Parameters of the thread density used at this time are set according to values inputted by the operator or values prestored in the ROM 9. The stitch data produced in this way are stored in the RAM 8.

Next, as mentioned previously, in S360 the counter i is incremented by one, thereby changing the color under investigation to the next color. Then the routine returns to S320. Once processes of S330 to S350 have been performed for all colors included in the second image data, then the routine proceeds to S370. In S370, the color code determined in S330 is added to the embroidery stitch data produced in S350. Embroidery data having a format usable by the sewing machine is then produced and stored in the RAM 8. The processing in S330 corresponds to thread color setting means, and the processing in S350 and S370 corresponds to embroidery data producing means.

Figure 10:
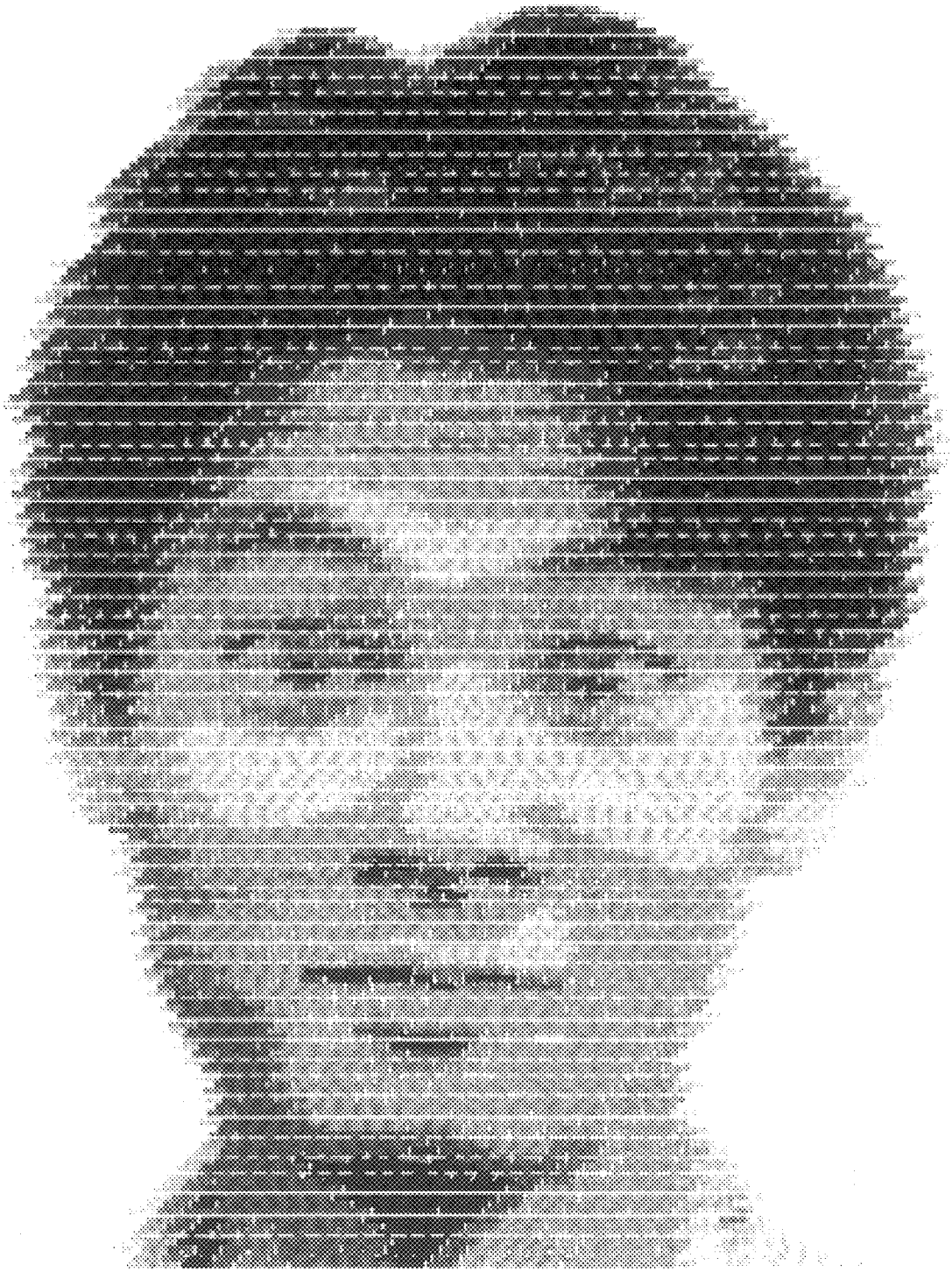
FIG. 10 shows stitch data generated from the mosaic image of FIG. 6 according to the embroidery data processing routine represented by the flowchart of FIG. 7.

The embroidery data produced in S370 is outputted to the memory card connector 5 through the input output interface 10, and written into the memory card 11 mounted in the memory card connector 5. By mounting the memory card 11 into a sewing machine, the operation of the sewing machine can be controlled to perform embroidery stitching based on the embroidery data corresponding to the image pattern retrieved in S10. Stitch data produced from the second image data of FIG. 6 is indicated in FIG. 10. As can be seen by comparing FIG. 10 with FIG. 26, vertical lines formed by the borders of vertically-aligned blocks are less likely to appear in stitch data produced in the manner described in the present embodiment. This is because the horizontal position of blocks that form the mosaic pattern are shifted in adjacent rows. Because the vertical resolution is enhanced, the total number of blocks is increased. Fine color gradation can be expressed in more detail.

Figure 26:
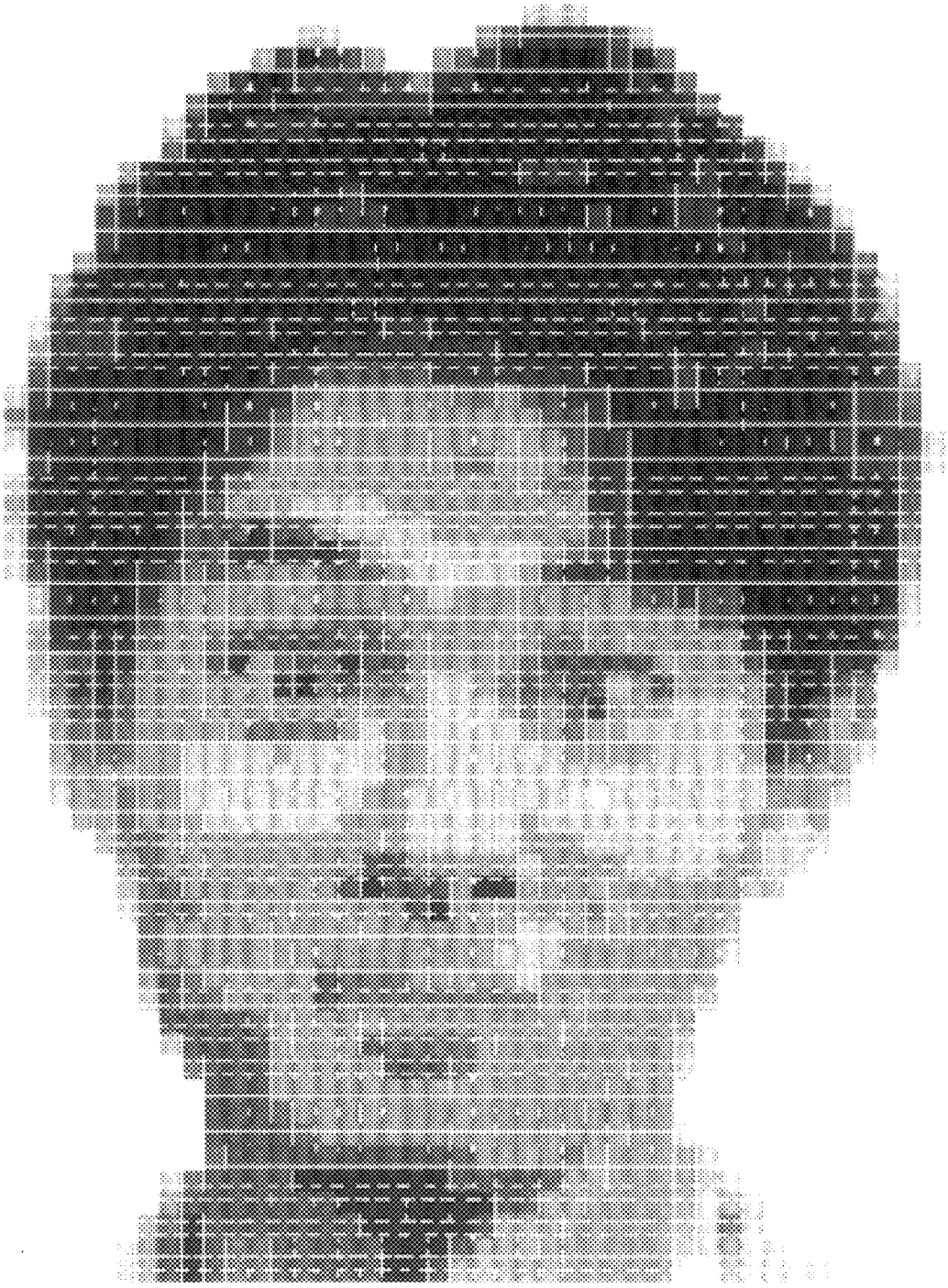
FIG. 26 RELATED ART
FIG. 26 is stitch data generated from the mosaic image of FIG. 25.

As described above, in the embroidery data processor according to the first embodiment of the present invention, inputted first data is first divided into blocks so that each block has a width parallel to the stitch direction that is longer than its width in the direction perpendicular to the stitch direction. Then a thread color is selected for each block, and embroidery data for sewing the blocks is produced. Accordingly, the embroidery data produced in the embroidery data processor is based on image-forming blocks that are rather large in the stitch direction. Therefore, adjacent stitch holes will not connect together. On the other hand, because the blocks have a rather small width in the direction perpendicular to the stitch direction, horizontal lines such as those that stand out quite sharply in FIG. 26, are less likely to appear.

Further, the position of the shorter length side of the block, the side being extending in the direction perpendicular to the stitching direction is displaced from each other with respect to the vertically neighboring blocks. In other words, the height wise edges are displaced from each other, so that the vertical lines are less likely to appear in the resultant image. If all of the blocks are not positioned so that they are not shifted from each other in the stitching direction. then all the height wise edges of the blocks will be in alignment. Therefore, the vertical lines, which extend in the height wise direction, will stand out as in the case shown in FIG. 26.

Figure 11:
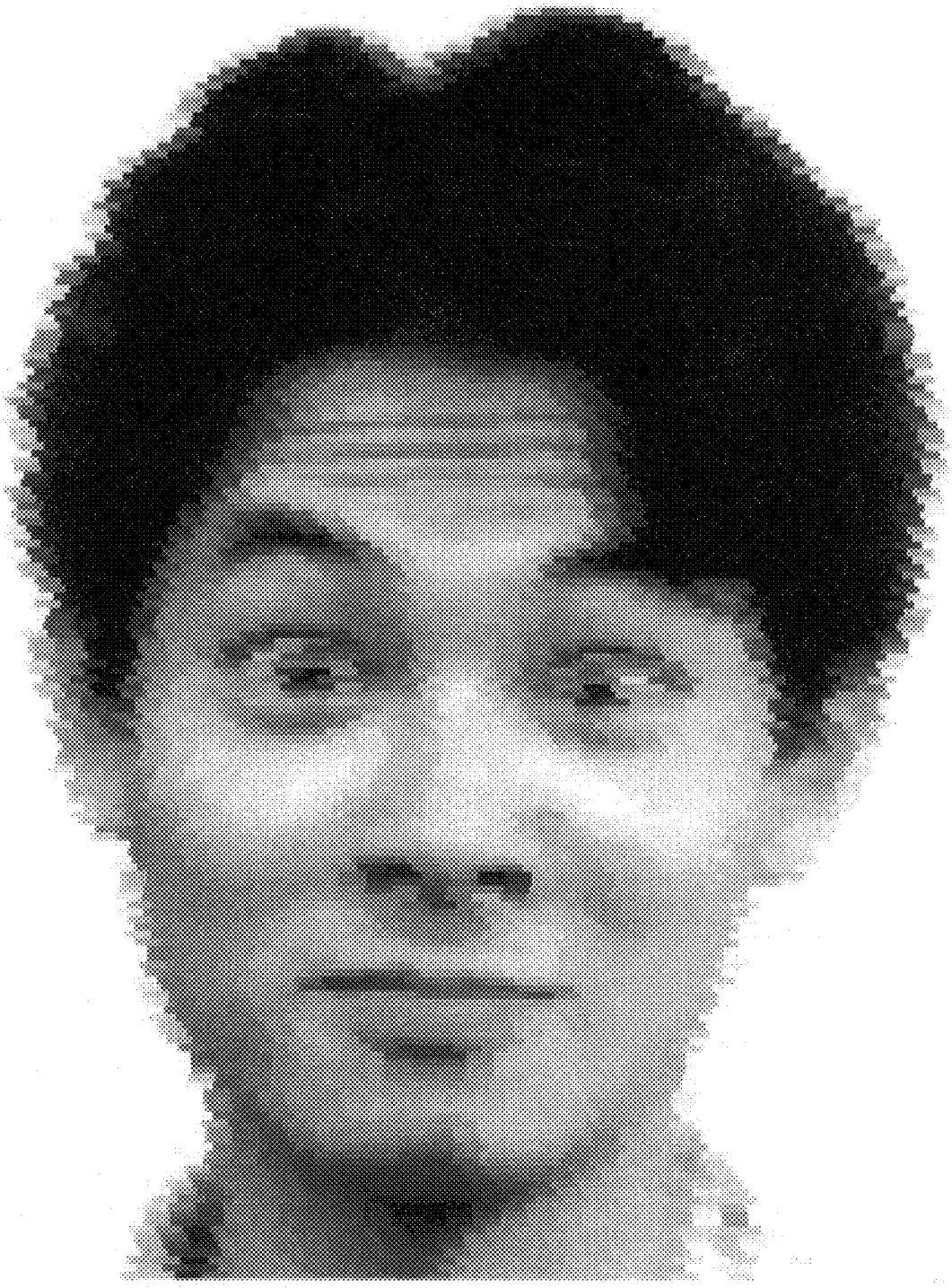
FIG. 11 is mosaic image generated from the image of FIG. 4 in which a starting position of each block row is determined using random numbers as per a second embodiment of the present invention.
Figure 12:
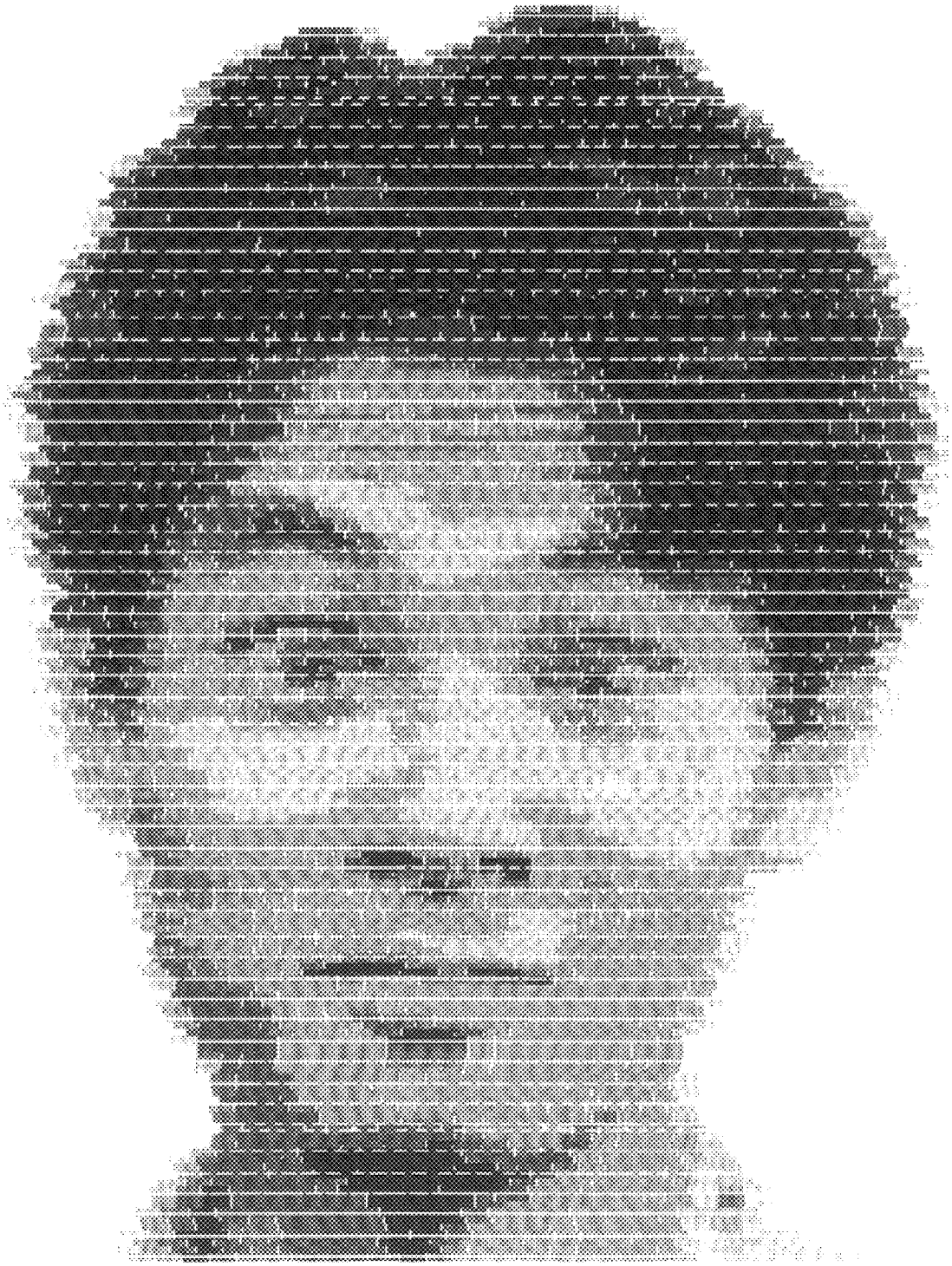
FIG. 12 shows stitch data generated from the mosaic data of FIG. 11.

Next, an embroidery data processor according to a second embodiment of the present invention will be described with reference to FIGS. 11 and 12. In the first embodiment, the block shifting amount is determined by a fixed value, that is, percentage of block width is inputted in S50. However, the block shifting amount can be determined separately for each row by using random numbers to set the horizontal starting position of the rows. FIG. 11 shows an image based on a second image data which is based on the image of FIG. 4 by randomly determining the horizontal start point of each row. FIG. 12 shows an image based on an embroidery stitch data based on the image of FIG. 11. As can be seen in these figures, blocks are less likely to appear because of less periodicity or less cyclical nature of the blocks in comparison with a case where the extent of shift is set by a fixed value.

Next, an embroidery data processor according to a third embodiment of the present invention will be described with reference to FIGS. 13 through 18. In the first and second embodiments, the first image data is converted into a mosaic, that is, second image data, of blocks that have a fixed height and width, and the blocks are shifted from each other in adjacent rows. On the other hand, according to the third embodiment, the width of the block is changeable when producing the second image data.

Figure 13:
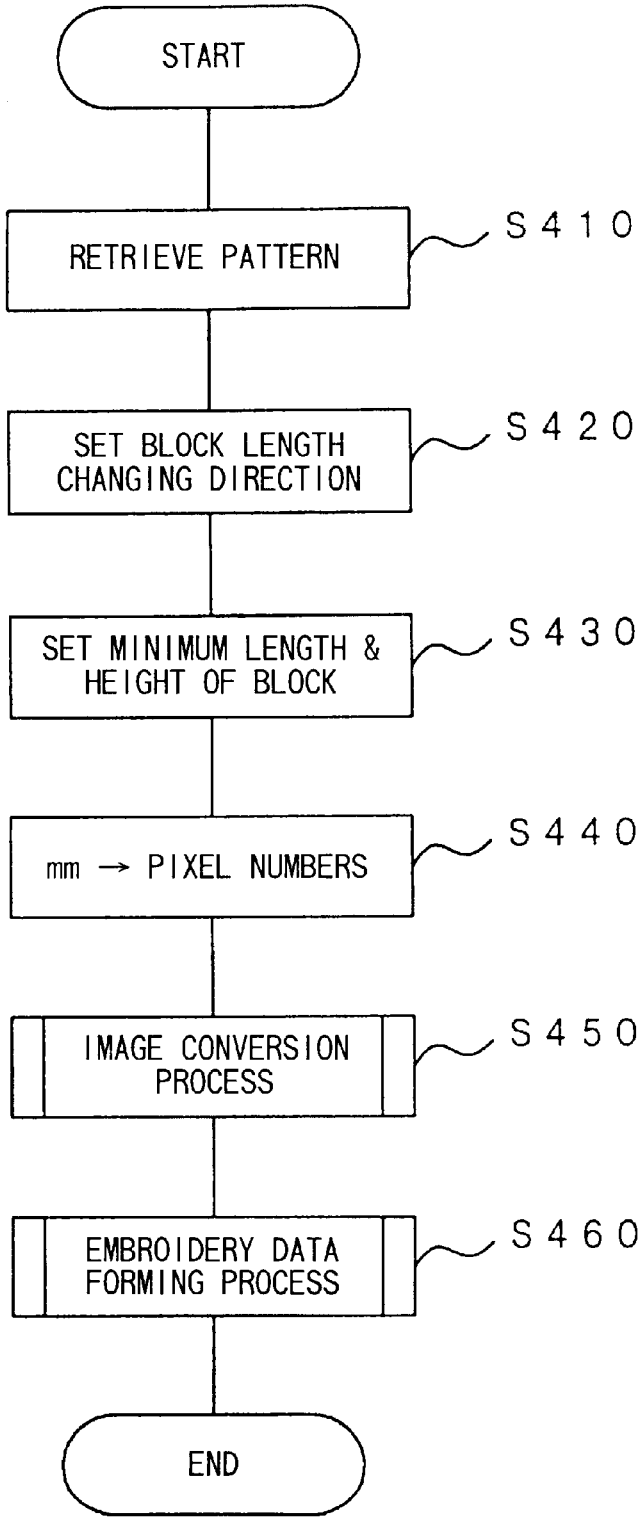
FIG. 13 is a flowchart representing an embroidery data processing routine according to a third embodiment of the present invention.

The flowchart of FIG. 13 represents processes according to the third embodiment, wherein blocks with different width in the stitching direction are generated from the first image data. First, in S410, the facial color photograph of FIG. 4 is retrieved using the image scanner 4. Next, in S420, block width changing direction is set, i.e., input is received for setting the direction in which block width is to be changed. This direction matches the direction in which stitches are sewn. In the same manner as in S20 of the first embodiment, the horizontal direction of the image is inputted in S420.

Next, in S430, the minimum width and height allowable for the blocks is inputted in millimeter units. The minimum width for the blocks is set to 3 mm and the minimum height Ifor the blocks is set to 1 mm, in a manner similar to that described for S30 of the first embodiment. In S440, the minimum width and height set in S430 is converted from millimeters into pixel numbers. The minimum width is converted from 3 mm to 12 pixels and the minimum height is converted from 1 mm to 4 pixels, in a manner similar to that described in S40 of the first embodiment.

Next, in S450 image conversion processing is executed based on the image inputted in S410. The details of this process will be described while referring to the flowchart of FIG. 14. In the same manner as described with reference to the flowchart of FIG. 5, a first row of the pattern image is broken down into blocks, starting from the upper left position of the pattern image. A representative color is set for each block. When the first row is completed, the row immediately beneath the first row is broken down into blocks in the same manner. This same process is repeated until all rows of the pattern image are converted into blocks and representative color is set for each block.

Figure 14:
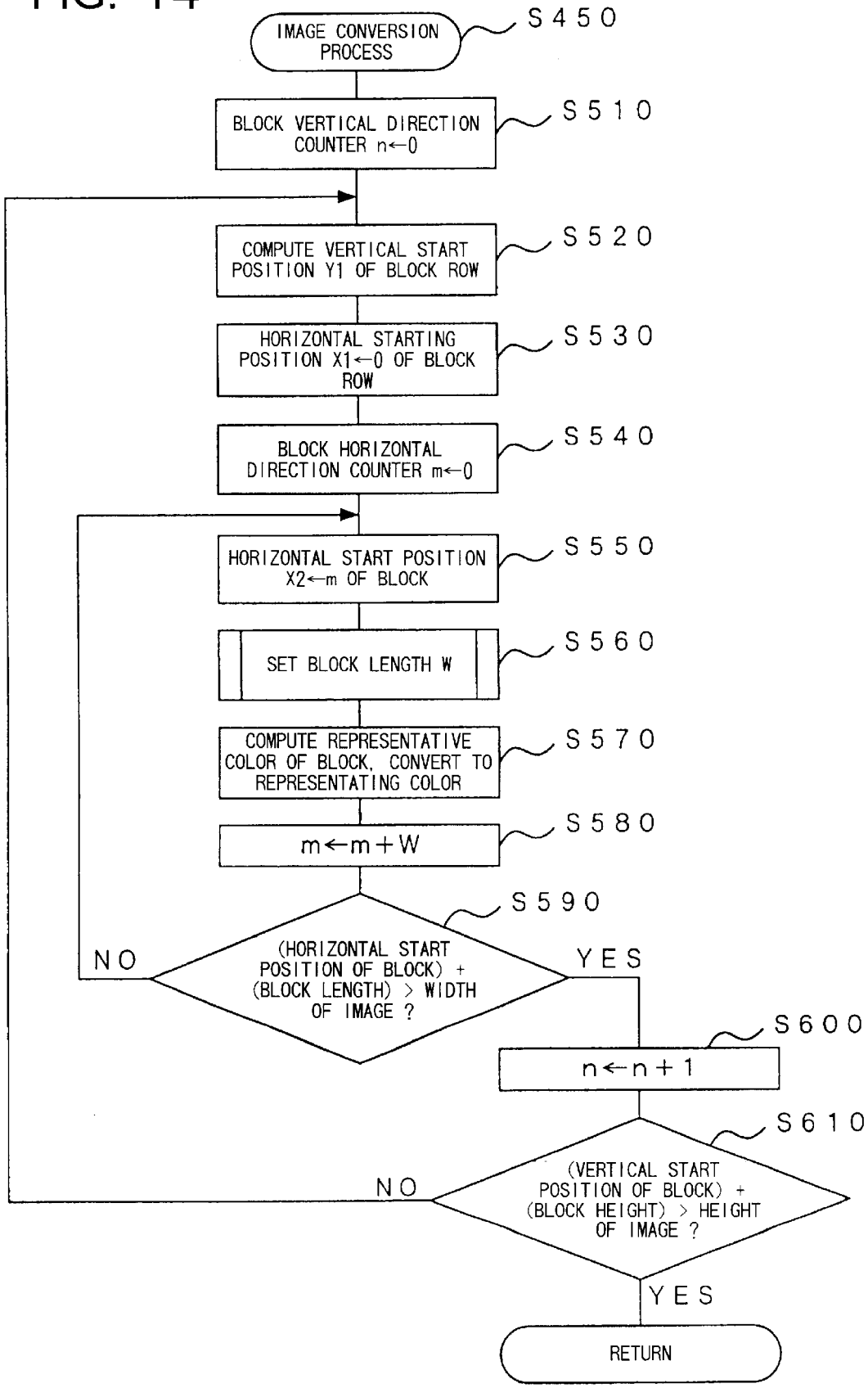
FIG. 14 is a flowchart representing an image conversion processing routine in the embroidery data processing routine of FIG. 13.
Figure 15:
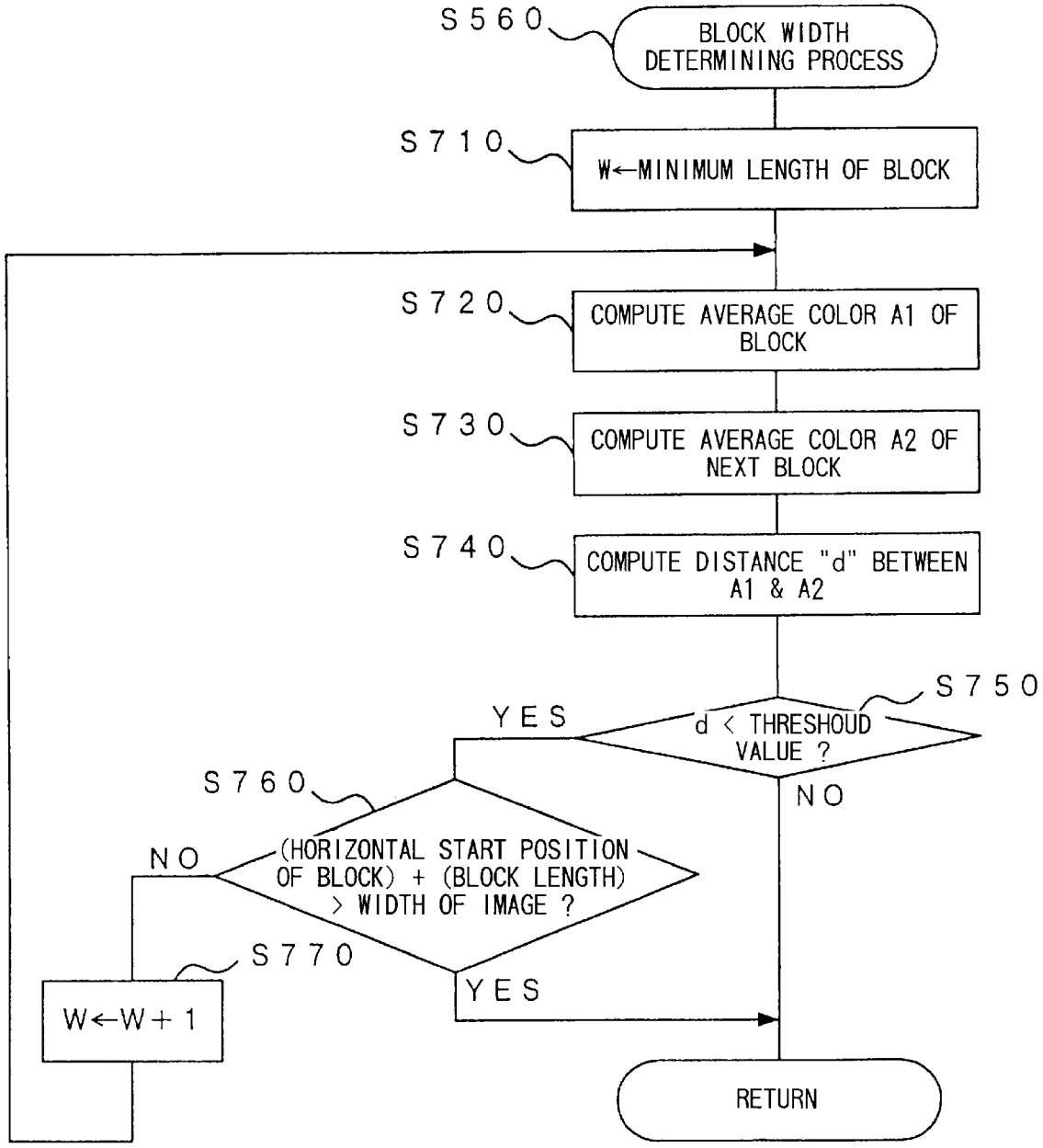
FIG. 15 is a flowchart representing a routine for determining block width(horizontal length), from the image conversion processing routine represented by the flowchart of FIG. 14.

As shown in FIG. 14, in the image converting process of S450, first in S510 the counter "n" is set to zero. The counter "n" represents the number of blocks in the vertical direction. In S520, the start position Y1 in the vertical direction of the subject row is computed In the same manner as in S120, that is, Y1=4×n.

Next, in S530 the start position X1 in the horizontal direction of the block row is computed. In this embodiment, the value of X1 is always zero. In S540, a counter "m" is set to zero. The counter "m" represents a block in the horizontal direction. In S550, the start position X2 is computed using the counter "m" to indicate the horizontal starting position of the block X2=m (or X2=X1+m, X1=0).

Next, in S560 the block width W (block length in the horizontal direction) is determined. This process will be explained while referring to the flowchart of FIG. 15. To set the block width W, first in S710 the minimum width that was inputted in S430 and converted into pixel number in S440 is set as the block width W. The block width W is set to 12 pixels in S710.

Then in S720, the average color Al of the block presently under investigation is computed. Although at this point the block at the upper left hand position of (X2, Y2) has a width W of 12 pixels and height of 4 pixels, this width W is changeable during a subsequent processes. The method of computing the average color Al is the same as used to compute the representative color in S160.

Figure 16:
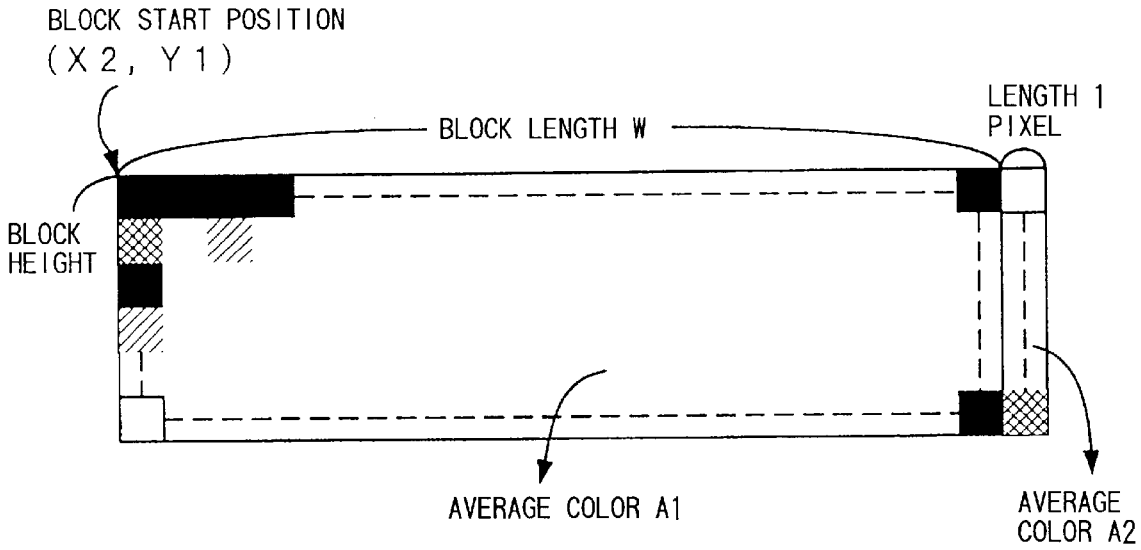
FIG. 16 is schematic view representing how block width increases according to average color width A2 of a subsequent block according to the third embodiment.

Next, in S730, the average color A2 of the next block is computed. As shown in FIG. 16, the "next block" is the block to the immediate right side of the present block and has a width of one pixel and a height of four pixels. Next, in S740, a distance "d" in RGB color system between the average color A1 and the average color A2 is computed using the above-described formula 1. In S750, it is determined whether the computed distance "d" is smaller than a predetermined threshold value T. If not smaller (S750:NO), then this routine is ended. That is, at this point the block width W is determined for the block presently being investigated. The threshold T can be a value prestored in the ROM 9 or a value inputted by an operator.

On the other hand, when the distance "d" is smaller than the threshold value T (S750:YES), then the routine proceeds to S760 where it is judged whether or not the sum of the horizontal start position of the present block and the present block width W exceeds the width of the overall image. If not (S760:NO). then the routine proceeds to S770, whereupon the block width is incremented by one. This means that the block that was determined to have the average color A2 is combined with the block that was determined to have the average color A1. Then the routine returns to S720 so that the above-described processes are repeated. Said differently, the average color A1 of the block under investigation is compared to the average color A2 of the next single-pixel width block to the immediate right. If the two average colors A1, A2 are similar to each other. that is, if the distance "d" is within the threshold T, then the next block is combined with the present block, so that the block width W is increased. The width W of the present block will continue to be increased by single pixel units as long as the average color A2 of the next block is similar to the average color A1 of the present block. This process is repeated until the width of the original image is reached.

Turning back to FIG. 14, once the width W of the block is set, then the routine proceeds to S570, and the representative color of the block under investigation is determined.

The RGB values obtained in this step are used to set the representative color of the block, and the step S570 is executed in a manner similar to S160.

Figure 17:
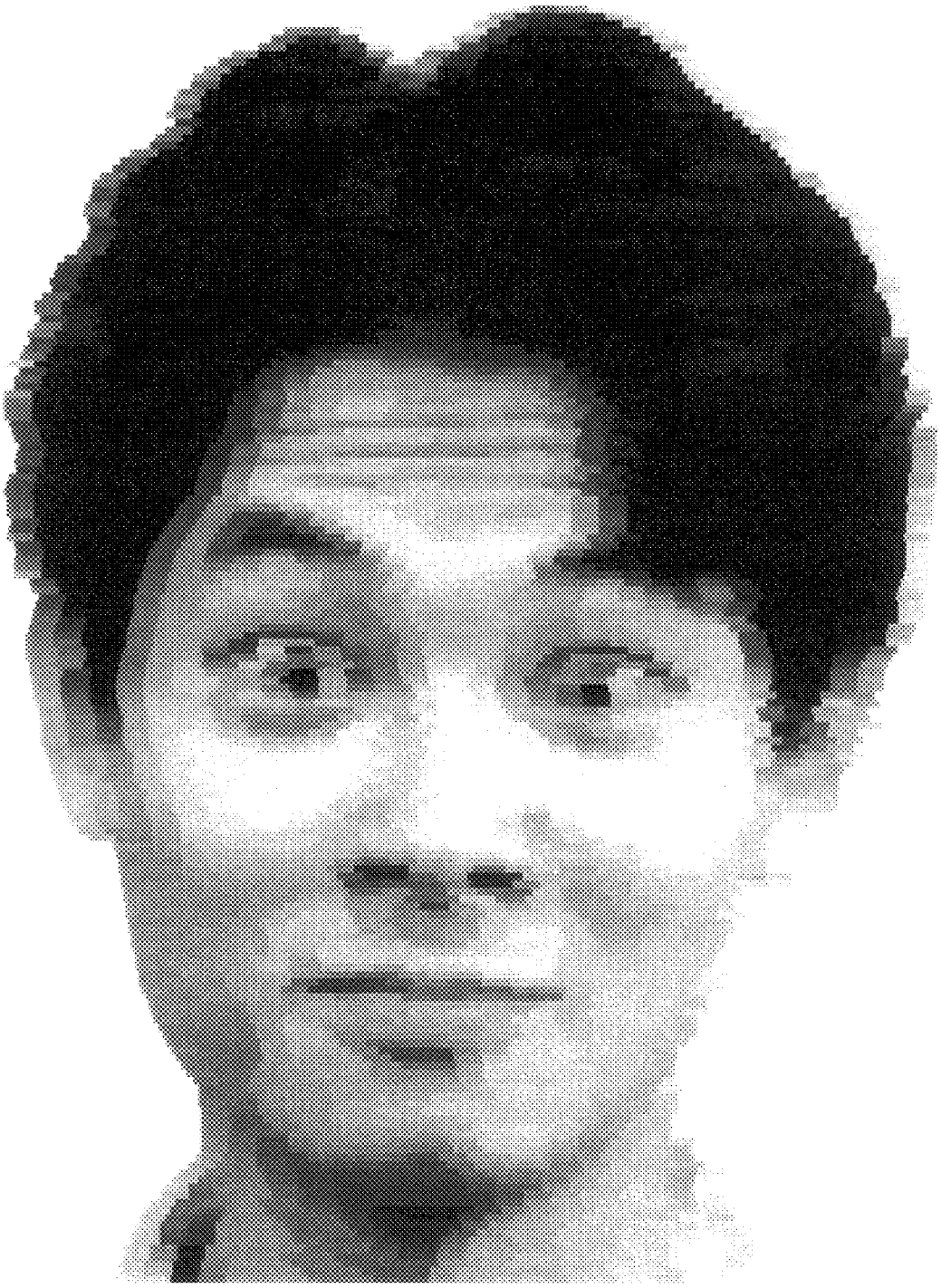
FIG. 17 is a mosaic image generated from the image of FIG. 4 using the image conversion processing routine represented by the flowchart of FIG. 14.

Next, in S580, the block width W is added to the counter "m". As a result, the counter "m" will indicate the left-hand position of the next block for which a representative color is to be determined. Next, in S590, determination is made as to whether or not image conversion process has been completed for all blocks of the row. This judgment is made by adding the minimum width of the block to the horizontal starting position of the present block, and judging whether or not the sum exceeds the width of the image. If not (S590:NO), then the routine returns to S550, to determine the width and representative color of the next block. Once image conversion has been performed for all blocks of the row (S590:YES), then the routine proceeds to S600, whereupon the counter "n" is incremented by one. Next, in S610 whether image conversion has been completed for all of the inputted first image data is judged by adding the block height to the vertical starting position of the subject block, and judging whether the sum exceeds the height of the entire image. When not all image conversion has been completed (S610:NO), then the routine returns to S520 to determine the width and representative colors for blocks of the next row. When image conversion is entirely completed (S610:YES), then this routine is ended. The image obtained by this image conversion process is shown in FIG. 17.

Figure 18:
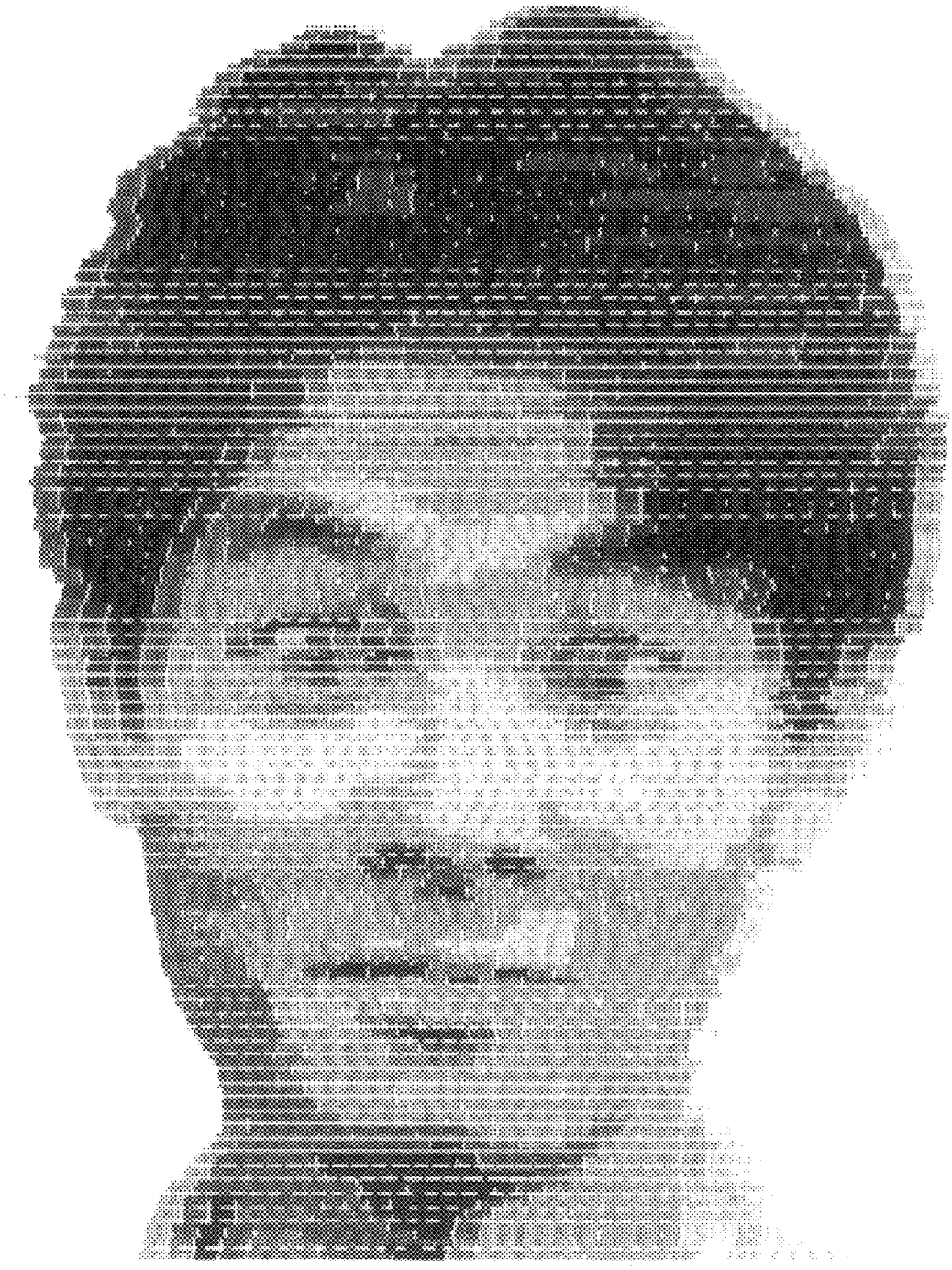
FIG. 18 shows stitch data generated from the mosaic image of FIG. 17.

Turning back to the flowchart of FIG. 13, when the image conversion process of S450 is completed, then the embroidery data producing routine is performed in S460. This embroidery data producing routine is the same as described with reference to the flowchart of FIG. 7. By performing this routine, the embroidery stitch data shown in FIG. 18 is produced from the conversion data shown in FIG. 17. As can be seen in FIG. 18, vertical and horizontal lines, which are quite prominent in FIG. 26, are relatively unnoticeable. Because the above-described processes change the block width depending on similarity of the colors between the neighboring blocks in the stitching direction, vertically adjacent blocks will be shifted horizontally from each other, unless the first image data is extremely orderly, such as when the entire image is a single color or has a lattice pattern. Stated differently, the horizontally shifting amount between vertically adjacent blocks is set independently for each block, because the width of the block under investigation is increased by the width of the next block in the horizontal direction when the average colors A1 and A2 of the present block and the next block are similar to each other. Compared with the stitch data of FIG. 12. wherein the vertical block shift was determined by random numbers for each line, the stitch data shown in FIG. 18 provides superior image reproduction. Thus, according to the third embodiment, sharp changes in color tone are less likely to appear in the resultant image. Further, the generated blocks always have a width in the stitch direction that is larger than the minimum width. Therefore, appropriate embroidery data can be produced. This feature is particularly effective when the block width is variable in the manner described above.

Figure 19:
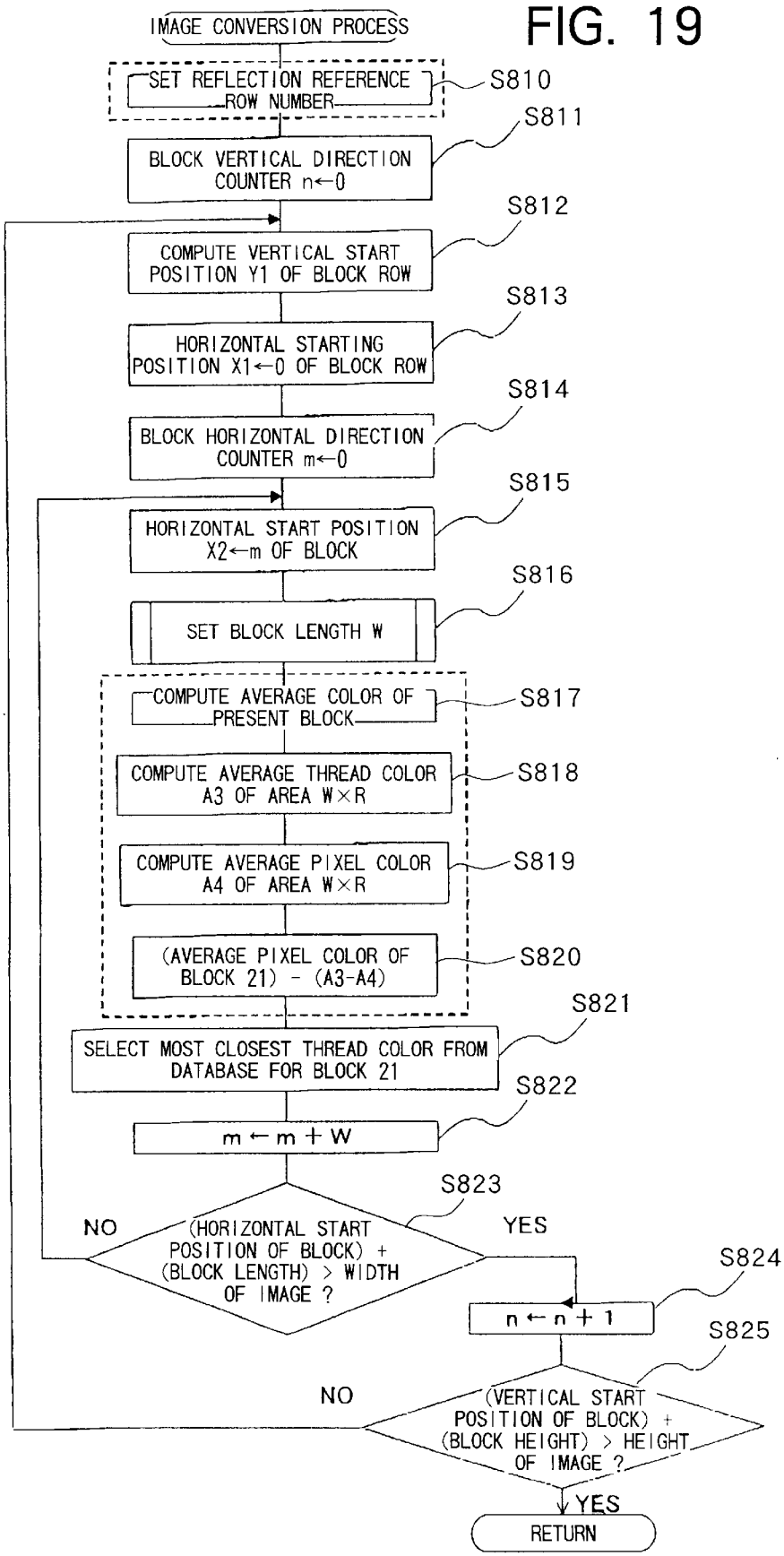
FIG. 19 is a flowchart showing an image converting processing according to a fourth embodiment of the present invention.

Next, an embroidery data processor according to a fourth embodiment of the present invention will be described with reference to FIGS. 19 through 21 and 27. In S330 of the embroidery data producing routine of FIG. 7 according to the foregoing embodiments, a particular single color is focused on, and the corresponding thread color is determined based on color information for the single color and color information in the thread color database. However, according to the fourth embodiment, the thread color of the present block is influenced by the thread colors already determined for previous blocks. The fourth embodiment performs image conversion processing as shown in FIG. 19, which is similar to the processing executed in the third embodiment except a "color mixing processing (S810, and S817 through S820)" described later.

In the third embodiment, the step image conversion process is executed in S450 explained in the flowchart of FIG. 14. However, in the fourth embodiment, image conversion process shown in a flowchart of FIG. 19 is performed in the step S450 of FIG. 13.

Figure 20:
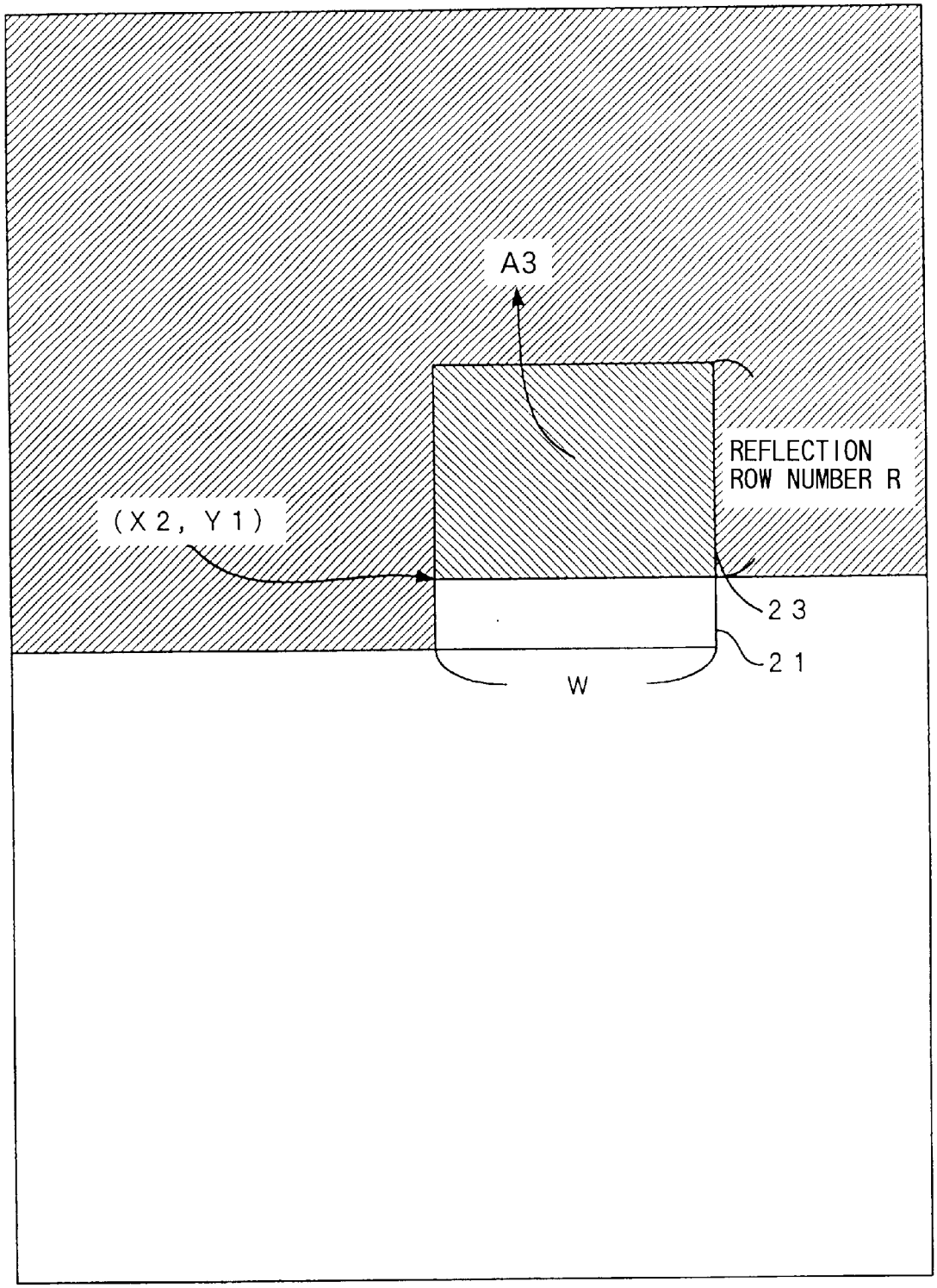
FIG. 20 is a schematic view showing a displayed image representing how influence of the average color A3 in an ambient block can be reflected for determining a thread color in a block under investigation, according to the fourth embodiment of the present invention.

As shown in FIG. 20, a rectangular region 23 directly above the present block 21 under investigation (i.e., present block for which the thread color is to be determined) is determined. The present block 21 has a block starting position (X2, Y2). The region 23 has the same width as the block 21 and a height defined by a reflection reference row number. It should be noted that the fourth embodiment is based on the configuration of the third embodiment. The thread color of the uppermost block row (first line) has determined in accordance with the step S570 and S330 of the third embodiment.

Regarding color mixing processing, in S817 a representative color (average color) of the present block 21 is computed in a manner of S160. Next, in S818, average thread color A3 is computed for the rectangular region 23. Because each pixels in a hatching area of FIG. 20 has color code, each pixels has R. G. B. values as defined in the thread color data base shown in FIG. 8. Therefore, average thread color A3 can be computed using all R.G.B. values associated with the color code in the rectangular region 23 in a manner similar to S160.

It should be noted that if the present block 21 is positioned in one of the higher rows, and so the row number above the present block is less than the reflection row number set in S810, the row number for the rectangular region 23 is changed to the existing row number positioned above the present block. For example, if the set reflection row number R is "three" rows, but there is only "two" rows above the present block, the reflection row number will become "two" with respect to the present block.

Figure 21:
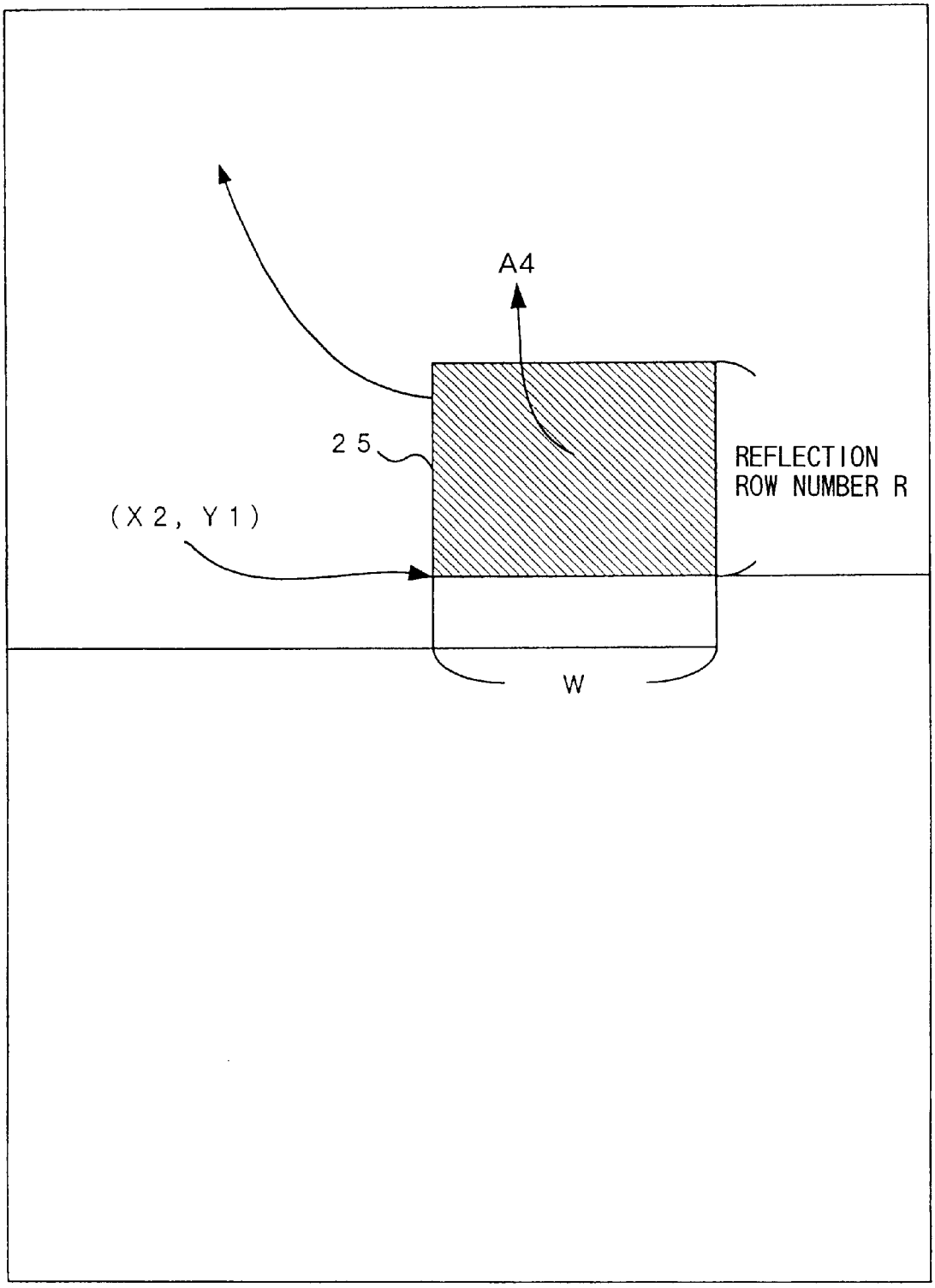
FIG. 21 is a schematic view showing a displayed image representing a process for determining the thread color in the block under investigation based on an average color A4 of pixels in the ambient block according to the forth embodiment.

Next, in S819, as shown in FIG. 21, using the first image data, the average color A4 of pixels in a rectangular region 25 corresponding to the rectangular region 23 are computed in a manner of S160. In FIG. 21, a hatching area 25 corresponds to the rectangular region 23.

Then in S820, the difference between the RGB values of the average thread color A3 and the RGB values of the average pixel color A4 is determined. This difference corresponds to a conversion error when converting the first image data into thread color data. The difference in RGB values determined here is subtracted from the RGB values of the average pixel color of the present block 21 to obtain a corrected RGB values of the average pixel color of the present block 21.

Figure 22:
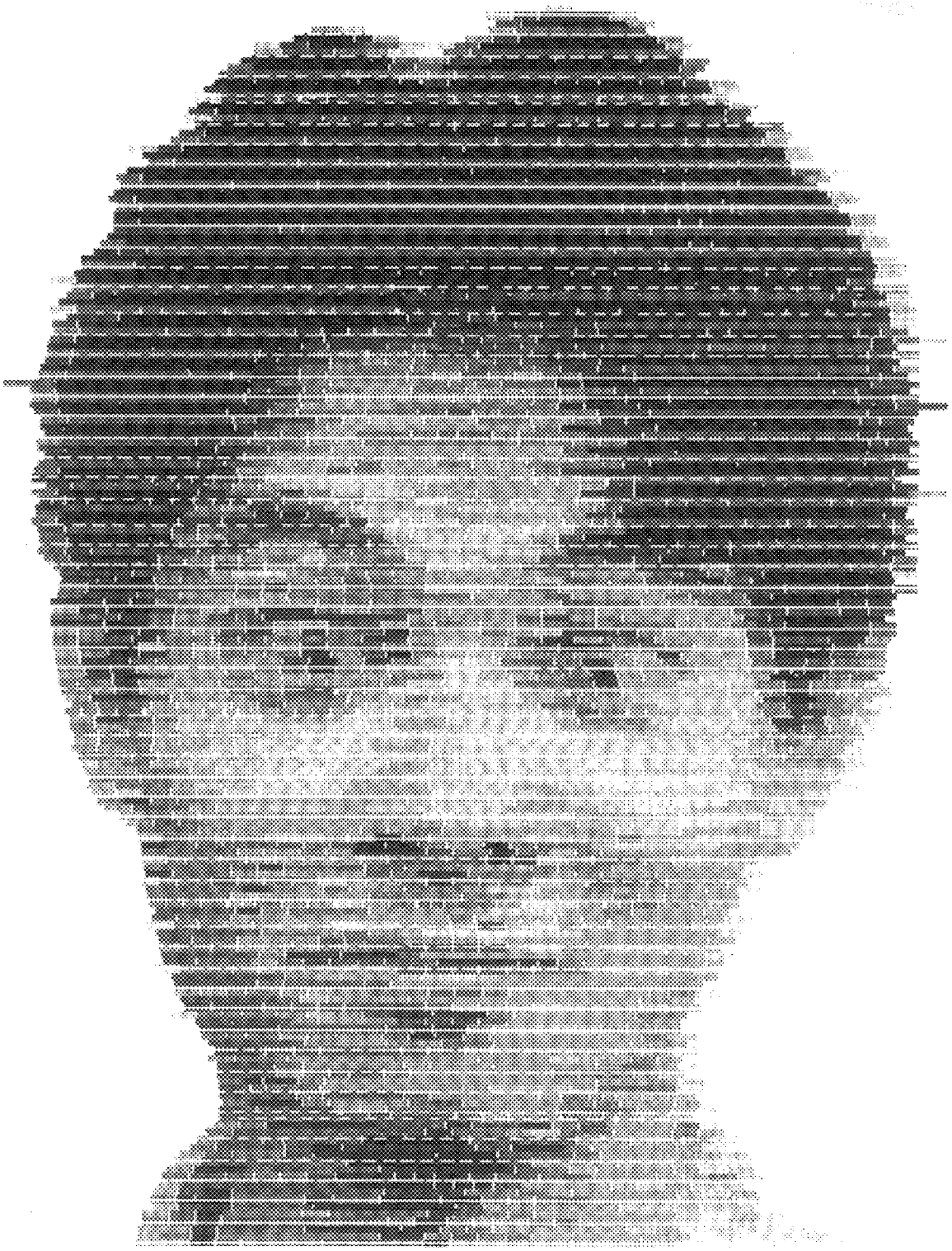
FIG. 22 shows stitch data generated by the process according to the fourth embodiment.
Figure 27:
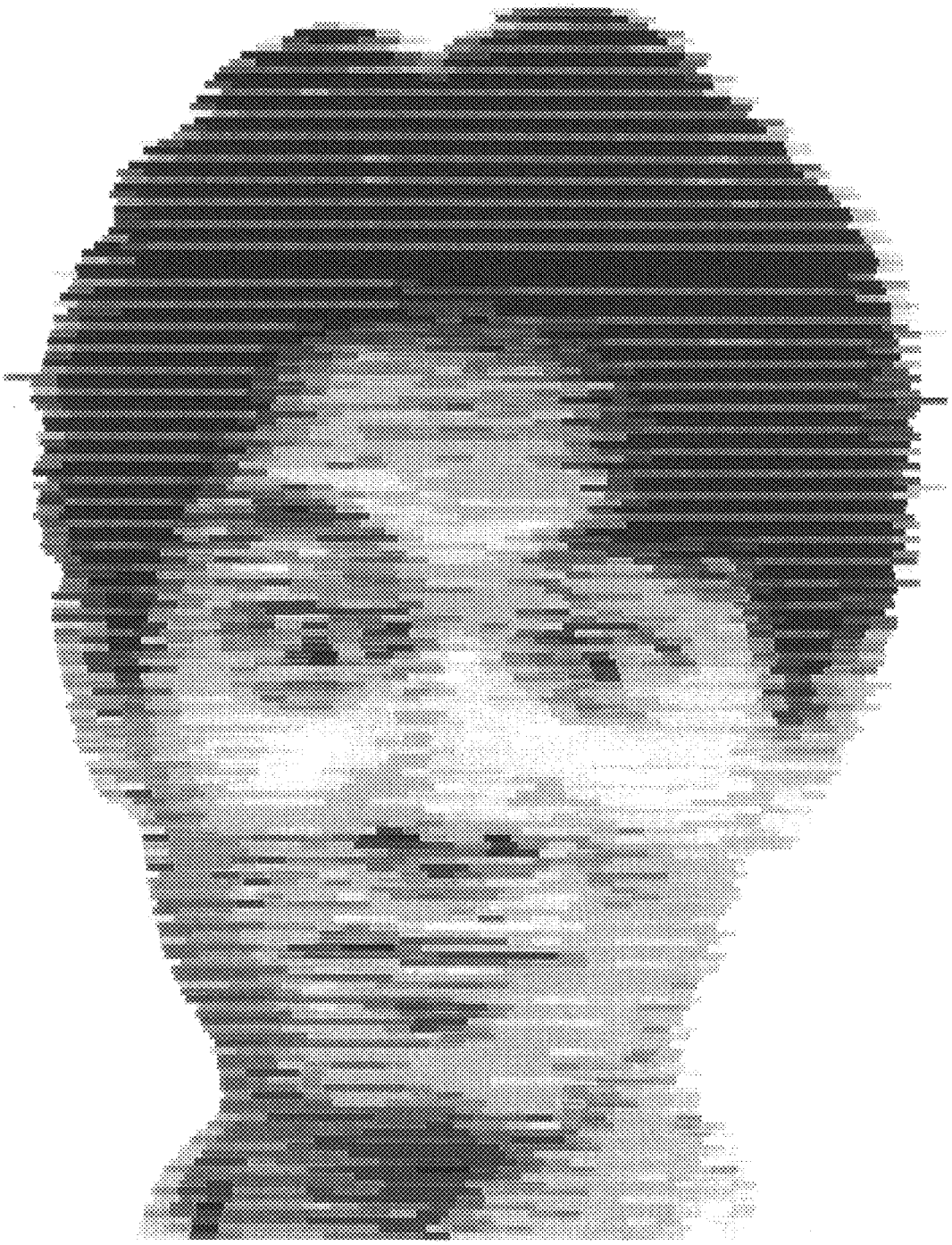
FIG. 27 is a mosaic image generated from the image of FIG. 4 using the image conversion processing routine represented by the flowchart of FIG. 19 according to the fourth embodiment.

Next, in S821, the thread color of the present block 21 is determined based on the formula 1 using the corrected RGB values and the RGB values of the color codes stored in the thread color database. Thus, a distance in RGB color system is computed in the manner the same as the step S330, and the thread color code providing the shortest distance is set as the thread color for filling in the present block 21 with the thread color. Next, the routine goes into S821 though S825, which are the same as S580 through S610 of the third embodiment, respectively. Thus, the process is performed for the entire area of the image. An image produced through the image conversion process according to the fourth embodiment is shown in FIG. 27 based on the image of FIG. 4. Further, The embroidery stitch data based on the image of FIG. 27 is shown in FIG. 22.

With this configuration, thread color of the present block reflects influence of thread colors in previously determined blocks. The influence of surrounding blocks is reflected when the image color is simulated to the thread color. Consequently, image data with colors nearer the colors of the original image pattern can be produced.

In the first to third embodiments of the present invention, there may be situations when the thread color determination means(S330) does not select the most appropriate thread color. However, according to the fourth embodiment, the difference is investigated between (a) and (b), (a) is the representative color of at least one block of the second image data, the thread color of the at least one block being already been determined, and (b) is the already determined thread color of the at least one block. The difference is taken into consideration for determining the thread color of the present block. Thus, the thread color finally determined can be more closer to the representative color of the second image data.

While the invention has been described in detail with reference to specific embodiments thereof, it would be apparent to those skilled in the art that various changes and modifications may be made therein without departing from the spirit and scope of the invention.

For example, in the above described embodiments, each block has a rectangular shape having a longer side extending in the stitching direction and a shorter side extending perpendicular to the longer side. However, the blocks can have the form of a parallelogram or have any other shape that is longer in one direction, that is, the stitch direction, than in the direction perpendicular to that direction.

Further in the above described embodiment, the image scanner 4 is used as an example of image input means. However, a digital camera or a digital video camera can be used instead of the image scanner 4. Also, a computer system serves as the image input means when an embroidery data processor receives first image data directly from the computer system over a network.

Further, in the depicted embodiments, the thread color information selection means can select the color nearest to the color information included in the block. However, the selection means can select a color that is completely different from the color information included in the block depending on the first image data.

Further, in the above depicted embodiments, shifting direction of the block is coincident with the stitching direction, i.e., horizontal direction of the image. However, the vertical direction, or any optional angle, can be used instead for the horizontal shifting direction. Here, an example will be provided for setting the block shifting direction to an optional angle. First, the block shifting direction is set to an optional angle θ. Next, the image is rotated by the angle θ. Then any of the image conversion processes described in the first to fourth embodiments are performed on the rotated image. Next, embroidery data is produced and the needle location coordinate points are rotated by the angle θ. With this configuration, image conversion and embroidery data production can be performed when the block shifting direction, that is, the stitch direction, is set to an optional angle. Thus, the stitch direction can be set to the vertical direction or to a slanted direction in accordance with the first image data. Therefore, embroidery data with excellent power of expression can be prepared by selecting the most appropriate stitch direction.

Further, in the third embodiment, the block width is increased rightwardly. However, depending on the first image data, there will be some cases where it is more appropriate to obtain second image data by increasing the width of blocks leftward. For example, assuming that the image is divided into a plurality of blocks whose block width is equal to each other, and assuming that the representative color of the rightmost end pixels of a block A is similar to the representative color of the all pixels of the next block B positioned at right side of the block A, but the representative color of the remaining pixels of the block A is quite different from the representative color of the all pixels of the block B. In such a case, the rightmost end pixels are preferably merged or combined with the next block B. This means leftward increase of the bock width. That is, the width of the block B is increased leftwardly by the one pixel width. The direction in which blocks in a row should be extended will depend on the first image data. Also, there will be situations wherein the direction will be alternatingly changed at every rows.

Figure 23:
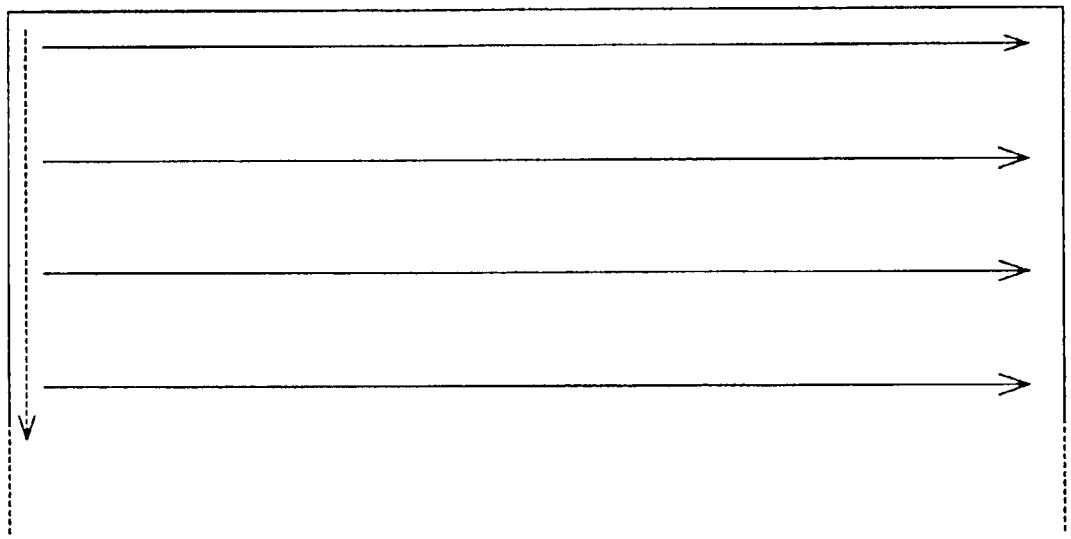
FIG. 23(*a*) is a view for description of block generating direction, in which blocks in each line are generated in the same direction.
Figure 23:
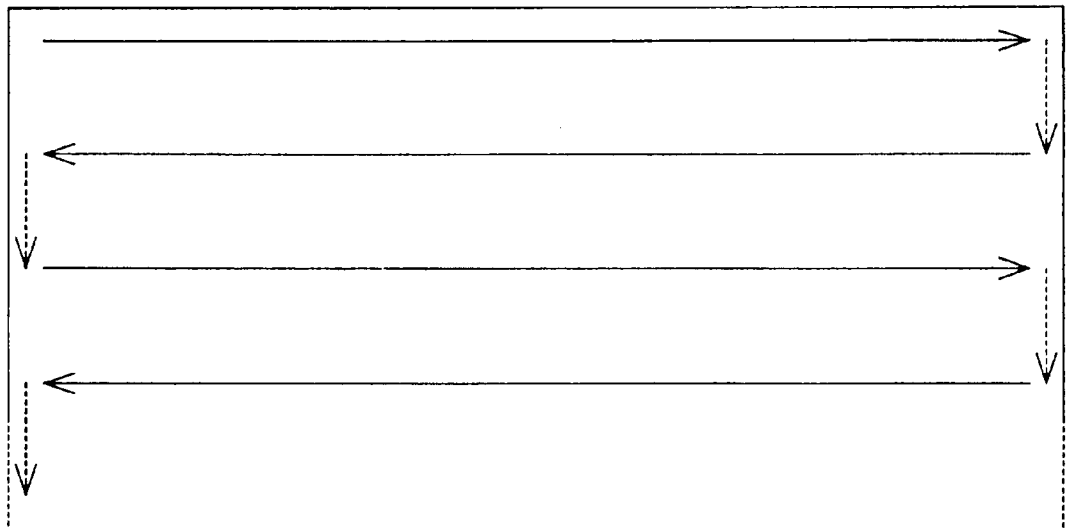
Figure 24:
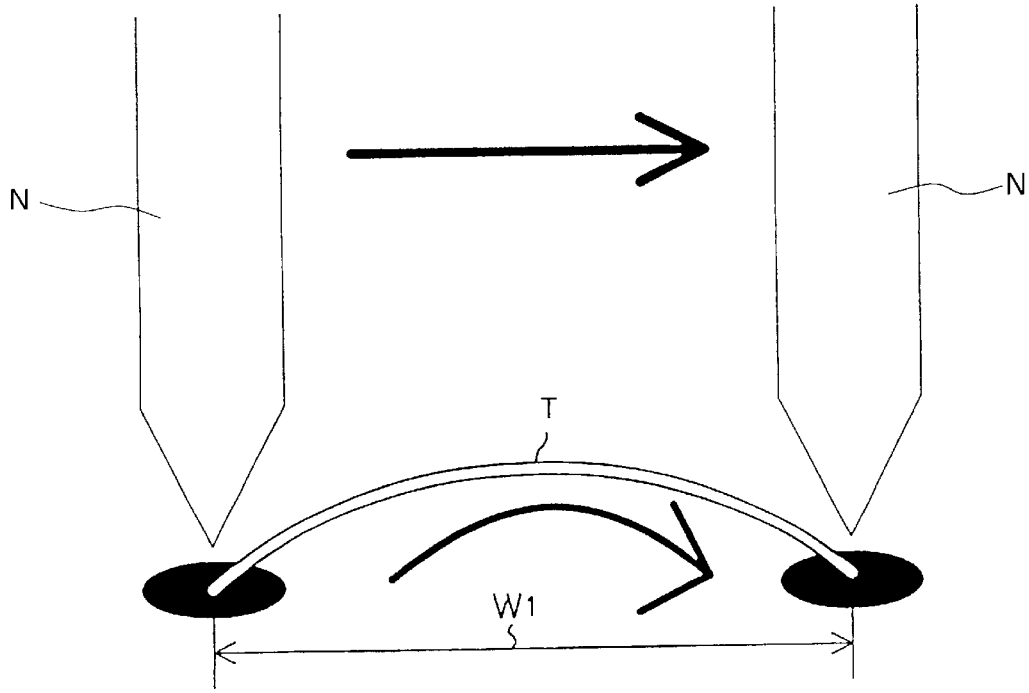
FIG. 24(*a*) is a schematic view showing a proper distance between adjacent needle locations.
Figure 24:
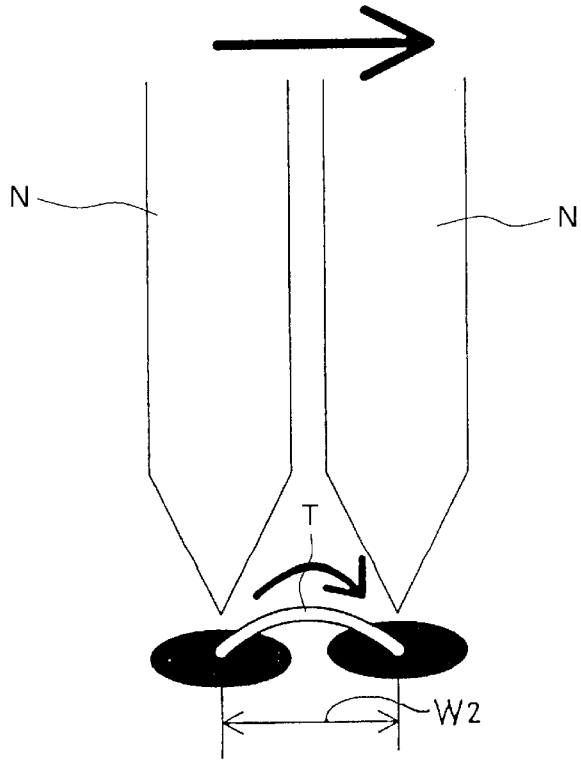
Figure 25:
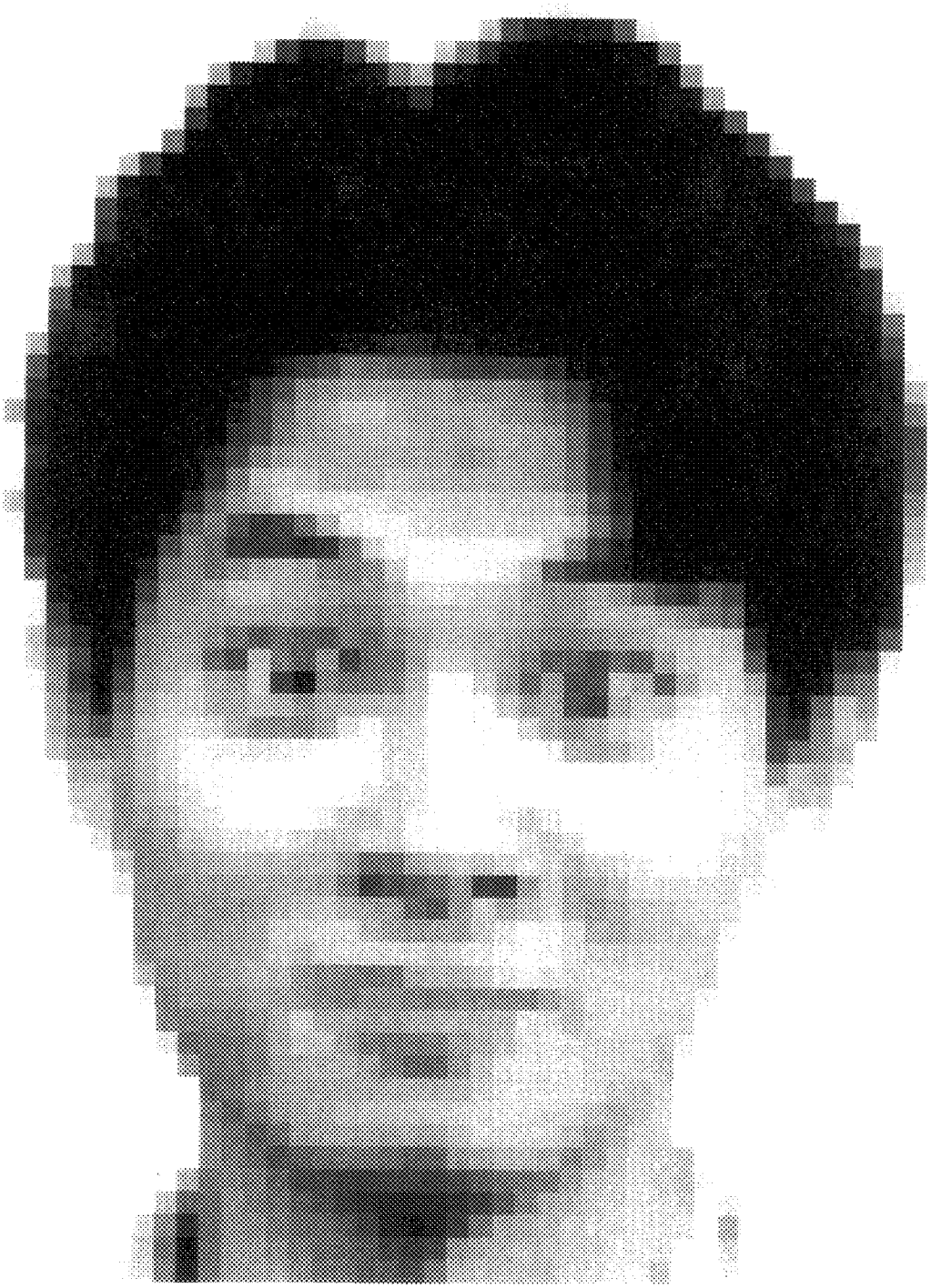
FIG. 25 RELATED ART
FIG. 25 is a mosaic image produced from the image of FIG. 4 with an appropriate stitch width according to a conceivable method.

Stated differently, in the third embodiment, block width increasing direction is always from left to right in each row of blocks as shown in FIG. 23(*a*). However, the direction of increase in block width can be reversed with each row as shown in FIG. 23(*b*). According to the latter mode, the blocks in about half of the rows in the first image data are generated in one direction, for example, rightward, and blocks in the remainder of the rows are generated in the opposite direction, that is, leftward in this example. Thus, directionality of the generated blocks can be prevented. In other words, by reversing the direction of image conversion with each line, the dependency on conversion direction can be dispersed, so that image data nearer to the original image can be produced.

Further, in the above described embodiments, although RGB space or color system is used to determine representative color and thread color, other color system, such as Lav color system(recommended by CIE), Luv color system (recommended by CIE), YIQ color system (standard color system for use in color television broadcasting used by NTSC (U.S. National Television Standard Committee), and HSI space can be used instead.

Further, in the above described embodiments, the average of pixel values in a block is determined to determine the representative color of the block. However, the representative color of blocks can be determined using a variety of methods. For example, the representative color of a block can be determined by weighted average of each pixel value in the block by weighting a specific portion of each block. Alternatively, the representative color of the block can be determined based on the pixel value of a single pixel at a predetermined position in the block. Further, the computed representative color can be optionally altered by an operator.

Further, the embroidery data processing portion 1 of the above described embodiments provisionally stores the embroidery data processing program in the ROM 9. However, the above described embroidery data processing can be performed with employing a computer system such as a personal computer. To this effect, a recording medium storing therein the above described programs can be used, and the medium is set in the computer to retrieve the programs from the recording medium. The recording medium can be any electromagnetic medium that can be loaded or installed on the computer. Examples include a floppy disk, a photo-magnetic disk, a CD-ROM, and a hard disk. Alternatively, a ROM or a backup RAM storing therein the program could be used as the recording medium. Then the ROM or backup RAM can be loaded into a terminal device or a printing control unit. If the program is stored in the floppy disk or in the CD-ROM, and if the program is needed, it can be retrieved and installed in a hard disk, and operated in a computer. Alternatively, the program can be retrieved from an external information processor using a wired or wireless transmission system, and can be operated in the computer.

What is claimed is:

1. An embroidery data processor for converting image data into embroidery data comprising:

means for holding a first image as first image data from an original image, the first image data containing color data;

means for storing a plurality of thread color data in which a relationship between thread color information and color codes is stored;

means for selecting thread color information from the plurality of thread color data stored in the storing means, the selecting means dividing the first image into a plurality of blocks, each block having a first side and a second side shorter than the first side, and the selecting means also selecting a thread color information from the plurality of thread color data stored in the storing means based on each color data contained in each block; and, means for producing embroidery data for performing embroidery stitching to each of the blocks with a selected color code corresponding to the selected thread color information.

2. The embroidery data processor as claimed in claim 1, wherein the blocks are arrayed in a block row in a stitching direction and a length of the first side of each block is greater than a distance between neighboring needle locations in the stitching direction for avoiding connection of needle holes.

3. The embroidery data processor as claimed in claim 2, further comprising means for inputting a stitching direction.

4. The embroidery data processor as claimed in claim 3, wherein the first side of the block extends in a direction parallel with the stitching direction.

5. The embroidery data processor as claimed in claim 4, wherein the first image has a width and a height, and wherein the selecting means comprises:

means for dividing the first image into a plurality of rectangular blocks arrayed in a block row in the stitching direction in parallel with the widthwise direction of the first image and stacked in the height direction of the first image, each rectangular block having the first side extending in the stitching direction and the second side extending in the height direction.

6. The embroidery data processor as claimed in claim 5, wherein the selecting means further comprises means for displacing a position of the second side so that a second side of an upper rectangular block is displaced in the stitching direction from a second side of a lower rectangular block positioned immediately below the upper rectangular block.

7. The embroidery data processor as claimed in claim 6, wherein the selecting means furthers comprises means for setting a displacing amount between the upper second side and a lower second side.

8. The embroidery data processor as claimed in claim 7, wherein the means for setting the displacing amount sets a random displacing amount for every block.

9. The embroidery data processor as claimed in claim 5, wherein the selecting means further comprises:

means for converting the first image data into second image data by determining a representative color for each block based on the color data contained in each block, a combination of the blocks each provided with the representative color comprising the second image data; and, means for setting thread color that selects and sets a color code stored in the thread color data storing means, the selected color code being in correspondence with a thread color information indicative of the representative color.

10. The embroidery data processor as claimed in claim 5, wherein the selecting means further comprises means for setting a minimum length of the first side of the block, a length of the first side being equal to or greater than the minimum length.

11. The embroidery data processor as claimed in claim 10, wherein the converting means comprises means for changing and determining a length of the first side of each block based on a color resemblance between a first representative color of a first block and a second representative color of a second block positioned beside the first block in the stitching direction.

12. The embroidery data processor as claimed in claim 11, wherein the first block contains a first plurality of pixels from which the first representative color is determined, and the second block has a first side length equal to one pixel width and contains a second plurality of pixels from which the second representative color is determined; and wherein the changing and determining means comprises:

means for computing the first representative color of the first block;

means for computing the second representative color of the second block;

means for judging resemblance of the first representative color with the second representative color; and, means for combining the first block and the second block together to provide a newly elongated first block if judging means judges that the resemblance of the first representative color with the second representative color is within a threshold level.

13. The embroidery data processor as claimed in claim 12, wherein the changing and determining means further comprises means for retrieving the minimum first side length set by the means for setting the minimum first side length of the block, the minimum first side length being an initial first side length of an initial first block.

14. The embroidery data processor as claimed in claim 12, wherein changing and determining means further comprises means for altering a direction of change of the length of the first side by every block row.

15. The embroidery data processor as claimed in claim 9, wherein the thread color setting means comprises:

means for setting a reflection block at a position immediately above a present block, the reflection block having vertical lines positioned in alignment with vertical lines of the present block and having a first side length equal to a first side length of the present block, the reflection block providing a representative color of pixels and a representative thread color; and means for determining a thread color of the present block based on a representative color of the present block and based on a difference between the representative thread color of the reflection block and the representative color of pixels of the reflection block.

16. The embroidery data processor as claimed in claim 15, wherein the means for determining the thread color of the present block comprises:

means for computing a representative color of pixels of the reflection block;

means for computing the representative thread color of the reflection block;

means for computing the representative color of pixels of the present block;

means for subtracting the difference between the representative thread color of the reflection block and the representative color of pixels of the reflection block from the computed representative color of pixels of the present block to obtain a corrected representative color of pixels of the present block; and means for computing the thread color of the present block based on the corrected representative color of pixels of the present block.

17. The embroidery data processor as claimed in claim 16, further comprising means for setting a reflection reference row number for the reflection block, the reflection block having a height corresponding to the reference row number.

18. A recording medium storing an embroidery data processing program for operating a computer system, the program comprising:

a program for holding a first image as first image data from an original image, the first image data containing color data;

a program for storing a plurality of thread color data in which a relationship between thread color information and color codes is stored;

a program for selecting thread color information from the plurality of thread color data stored in the storing means, the selecting means dividing the first image into a plurality of blocks, each block having a first side and a second side shorter than the first side, and selecting thread color information from the plurality of thread color data stored in the storing means based on each color data contained in each block; and, a program for producing embroidery data for performing embroidery stitching to each of the blocks with a selected color code corresponding to the selected thread color information.

* * * * *